US007137610B2

(12) United States Patent
Lam

(10) Patent No.: US 7,137,610 B2
(45) Date of Patent: Nov. 21, 2006

(54) WELLHEAD PRODUCTION BLOWOUT PREVENTER

(75) Inventor: Tony M. Lam, Edmonton (CA)

(73) Assignee: Stream-Flo Industries Ltd., Edmonton (CA)

( * ) Notice: Subject to any disclaimer, the term of this patent is extended or adjusted under 35 U.S.C. 154(b) by 110 days.

(21) Appl. No.: 10/789,954

(22) Filed: Feb. 27, 2004

(65) Prior Publication Data

US 2004/0262551 A1 Dec. 30, 2004

Related U.S. Application Data

(60) Provisional application No. 60/493,021, filed on Aug. 5, 2003, provisional application No. 60/484,029, filed on Jun. 30, 2003.

(51) Int. Cl.
*E21B 33/06* (2006.01)

(52) U.S. Cl. ..... 251/1.3; 251/1.1

(58) Field of Classification Search ..... 251/1.1, 251/1.2, 1.3, 63

See application file for complete search history.

(56) References Cited

U.S. PATENT DOCUMENTS

| | | | | |
|---|---|---|---|---|
| 1,963,683 | A | 6/1934 | Shaffer | 251/1.3 |
| 2,593,793 | A | 4/1952 | Rector | 277/325 |
| 2,604,903 | A | 7/1952 | Neilon | 277/325 |
| 2,749,078 | A | 6/1956 | Losey | 277/325 |
| 2,760,751 | A | 8/1956 | Wilde | 251/1.3 |

(Continued)

FOREIGN PATENT DOCUMENTS

CA 2260655 2/1999

*Primary Examiner*—J. Casimer Jacyna
(74) *Attorney, Agent, or Firm*—Greenlee Winner and Sullivan PC

(57) ABSTRACT

The invention broadly provides a ram incorporating a thermoplastic seal for sealing in the horizontal bore of a wellhead production blowout preventer to close off the vertical bore of the well, the ram being adapted to seal at its front end against either a polish rod of a rod string, or against an adjacent ram. The invention also extends to a BOP including a pair of such rams, wherein, each ram includes (a) a body component with front and rear portions and ends, (b) a seal component with front and rear portions and ends, (c) the body component having an arcuate longitudinal outer surface for conforming with the horizontal bore surface, and having a cut-out in its front portion which provides a seal support surface to support the seal component in both a vertical and horizontal direction, (d) the seal component having an arcuate longitudinal outer surface for conforming with the horizontal bore surface, and an inner surface which generally conforms to the seal support surface of the body component, the body component and seal components combining, in an assembled form, to form a full bore ram body, which when out of sealing engagement has the front end of the seal component protruding a horizontal distance d beyond the front end of the body component, (e) connectors for connecting the seal and body components while allowing the seal component, during sealing engagement, to be pressed against the seal support surface of the body component, and (f) the seal component providing a sealing surface formed of thermoplastic material around the arcuate outer surface for sealing against the horizontal bore. Thus, as the body component is advanced forwardly into a sealing engagement causing the front end of the seal component to contact either the adjacent ram or the polish rod to seal off the vertical bore, the seal component is pressed against the seal support surface of the body component such that the thermoplastic sealing surface is compressed outwardly to seal against the horizontal bore.

49 Claims, 27 Drawing Sheets

U.S. PATENT DOCUMENTS

| | | | | |
|---|---|---|---|---|
| 3,023,994 | A | 3/1962 | Gibson et al. | 251/1.3 |
| 3,904,212 | A | 9/1975 | Pugh et al. | 277/126 |
| 4,132,265 | A | 1/1979 | Williams, Jr. | 166/55 |
| 4,332,367 | A | 6/1982 | Nelson | 251/1 A |
| 4,398,729 | A | 8/1983 | Bishop et al. | 277/73 |
| 4,416,441 | A | 11/1983 | Van Winkle | 251/1 A |
| 4,770,387 | A | 9/1988 | Granger | 251/1.3 |
| 4,877,217 | A | 10/1989 | Peil et al. | 251/1.3 |
| 5,127,623 | A | 7/1992 | McDugle | 251/1.3 |
| 5,765,813 | A | 6/1998 | Lam et al. | 251/1.3 |
| 5,833,208 | A * | 11/1998 | Lee, Jr. | 251/1.3 |
| 6,089,526 | A | 7/2000 | Olson | 251/1.3 |
| 6,260,817 | B1 | 7/2001 | Lam et al. | 251/1.3 |
| 2004/0113108 | A1 * | 6/2004 | Ward | 251/1.3 |

* cited by examiner

FIG. 6
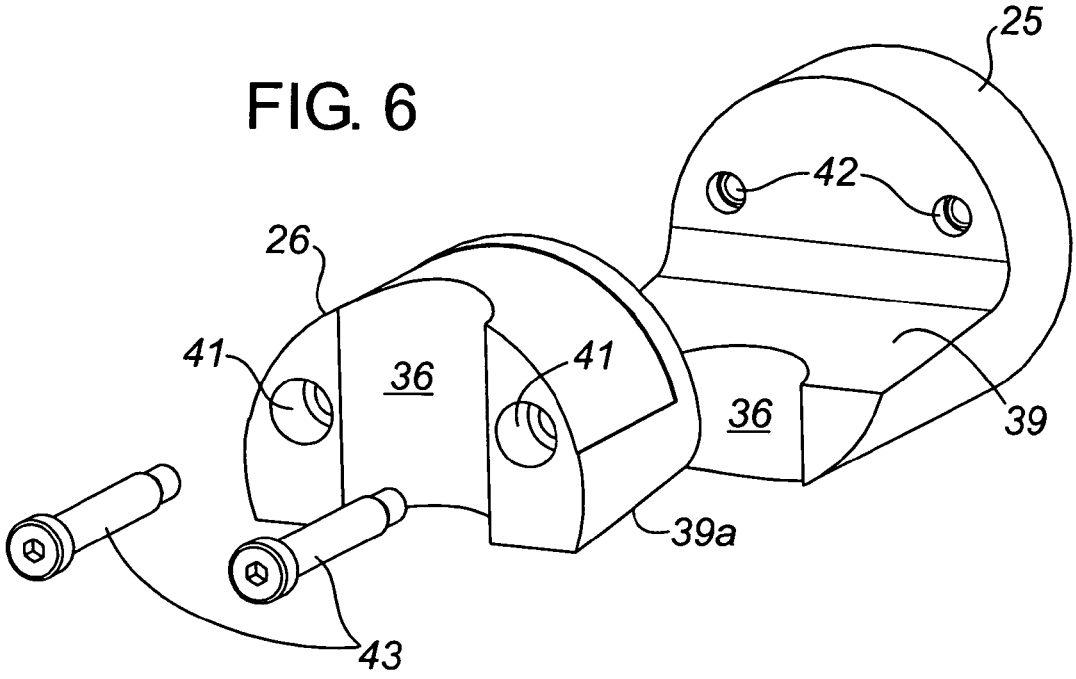
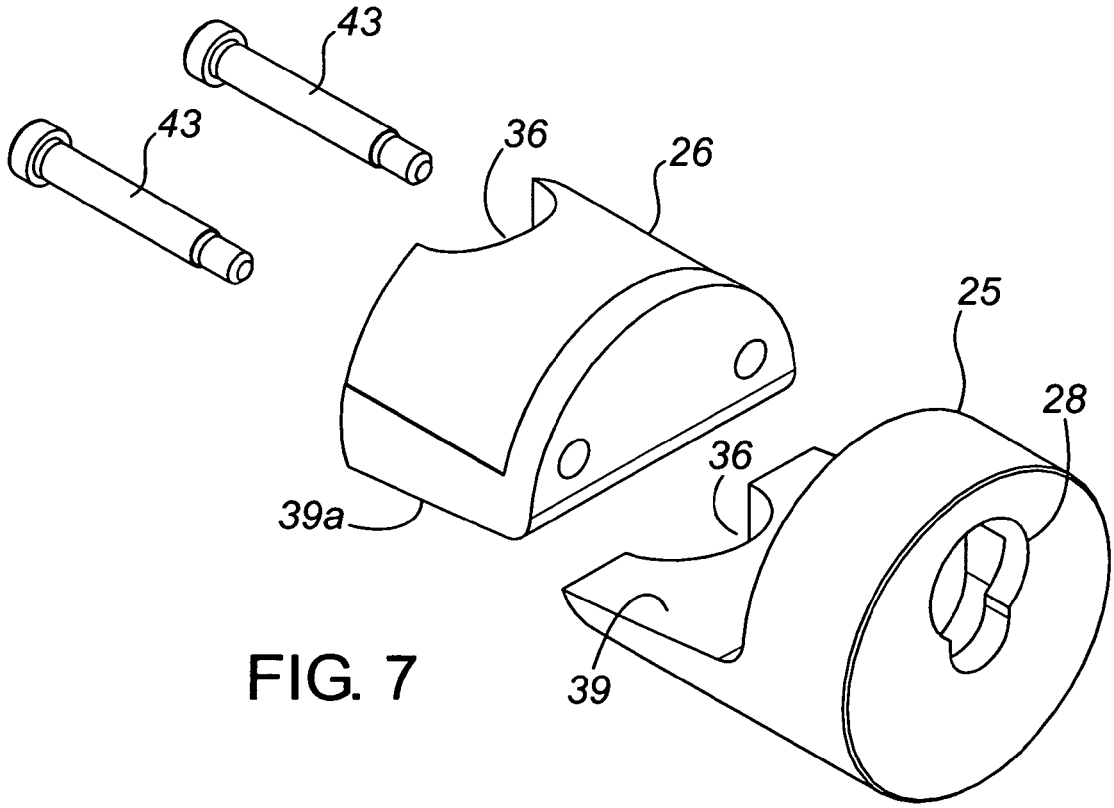
FIG. 7

WELLHEAD PRODUCTION BLOWOUT PREVENTER

CROSS-REFERENCE TO RELATED APPLICATIONS

This application claims priority to U.S. Provisional Application No. 60/484,029 filed Jun. 30, 2003, and U.S. Provisional Application No. 60/493,021 filed Aug. 5, 2003, both of which are incorporated herein to the extent not inconsistent herewith.

FIELD OF THE INVENTION

This invention relates to improvements in the seals of a wellhead production blowout preventer (BOP).

BACKGROUND OF THE INVENTION

The invention provides a blowout preventer (hereinafter "BOP") with improved seal components for the rams.

One example of a prior art BOP is disclosed in U.S. Pat. No. 5,765,813 to Lam et al., issued Jun. 16, 1998. This type of BOP is commonly used in connection with pumping wells. With such wells, a sucker rod string is reciprocated or rotated to drive a downhole pump, which lifts the produced fluid to surface through a tubing string. The BOP is equipped with rams which can be advanced horizontally to seal around the vertical polish rod of the rod string, to prevent the upward escape of fluid. Alternatively, if the rod string is out of the well, the inner ends of the rams can be pressed together to cause closure of the wellhead assembly fluid passageway.

More particularly, the prior art BOP includes a cross-shaped housing forming a vertical bore and a pair of coaxial, horizontal ram bores intersecting the vertical bore from each side. The BOP is commonly positioned in the wellhead assembly between the tubing head and flow tee. In such an embodiment, the BOP vertical bore forms part of the wellhead assembly fluid passageway.

Within the BOP, a pair of rams is positioned in the horizontal ram bores. Means, such as screw jacks or hydraulic actuators, are provided at the outer ends of the ram bores, for advancing or retracting the rams into or out of the vertical bore, in order to close or open the vertical well bore.

Each ram comprises a generally cylindrical body. The body comprises a steel core having an outer full diameter portion and a reduced diameter inner portion. The ram core inner portion is covered with and bonded to a layer of an elastomer, typically nitrile rubber.

The cylindrical ram bores extend into the vertical bore and the bore surfaces combine at their intersection to form sealing areas. When the rams move into the vertical bore, the rubber surfaces of their inner portions seal against the sealing surfaces.

The rubber-coated inner face of each ram is formed to provide a semi-circular, vertically directed groove. Thus, when the polish rod of the rod string is present in the vertical bore, the ram ends encircle and press against it, to form a seal of the vertical bore. When the polish rod is not in the vertical bore, the ram ends compress together to form a solid block. In both cases, the circumferential seals of the ram side surfaces with the sealing areas and the end face seals combine to close the vertical bore and contain pressurized fluids seeking to pass therethrough.

One major problem associated with production BOP's is that the pressure acting from below on the closed rams may extrude the side rubber upwardly so that the circumferential seal with the sealing areas is lost. Another problem is that the end rubber bonded to the vertical end faces of the ram cores may tear loose from the core when high pressure is exerted from below. In severe conditions such as injecting chemicals to close off a well, the rubber degrades quickly, causing the seals to fail.

In U.S. Pat. No. 5,765,813, the side surface of each ram core inner portion is formed to provide ribs extending outwardly therefrom and extending longitudinally thereof. The ribs are located so as to underlie those portions of the elastomer layer which seal against the sealing areas. The elastomer layer is thinned where it passes over the ribs, to preserve the cylindrical shape of the ram's inner portion. The ribs function to reinforce the elastomer layer against upward extrusion. Comparative pressure tests have shown that a ribbed ram was able to contain several times the pressure that a non-ribbed ram could contain, before the seal was lost.

In accordance with a preferred feature of U.S. Pat. No. 5,765,813, the vertical end face of the core inner portion is indented, for example with a plurality of spaced apart transverse grooves or dimples or a single cavity, so that the base of the elastomer layer projects into these indentations. As a result, increased face surface area is provided to bond with the elastomer. In addition, the elastomer external of the indentations must shear from the elastomer in the indentations, before failure occurs and the elastomer separates from the steel. In this way, the resistance to failure of the elastomer/steel bond at the ram end faces is improved.

The device of U.S. Pat. No. 5,765,813 improves the ability of the BOP ram to seal against the high pressure from below without losing the side seal, and better prevent against the rubber being torn loose from the ram.

Canadian Patent Application No. 2,260,655, published Aug. 2, 2000, and owned by Stream-Flo Industries Ltd., describes a ram type BOP for high temperature applications. The BOP incorporates a generally L-shaped seal element formed of a graphite or asbestos seal material, which is sandwiched between a bottom L-shaped steel retainer plate and a semi-cylindrically shaped steel top retainer plate. This design of BOP ram is well suited for brittle seal materials such as graphite and asbestos, which are used when steaming of the well may occur.

Other prior art BOPs using L-shaped seal elements or similar devices are described in the patent literature, but all utilize rubber-type sealing material sandwiched between steel body components, for instance, see U.S. Pat. No. 1,963,683 issued Jun. 19, 1934 to Shaffer; U.S. Pat. No. 3,023,994 issued Mar. 6, 1962 to Gibson; U.S. Pat. No. 3,904,212, issued Sep. 9, 1975 to Pugh et al.; and U.S. Pat. No. 4,416,441 issued Nov. 22, 1983 to Van Winkle.

None of the above patents adequately provide BOPs for use in harsh chemical conditions. Rubber-type seal materials are subject to being degraded by the harsh conditions of some wellheads, for example where chemicals are injected. For instance, in wells in which heavy wax deposits accumulate in the annulus, outlet lines, and anywhere that the production fluid flows, a chemical inhibitor is introduced into the production fluid as a means to break down the deposits. While the inhibitor is effective in clearing the lines, it has the major disadvantage of acting as a dissolving agent on the O-ring seals, rubber ram inserts and any elastomeric materials found inside the wells, causing these seals to fail prematurely.

Thermoplastic materials having superior chemical resistance are available, but have different compressibility and elastic properties than elastomeric sealing materials such as nitrile rubbers. Thus, the prior art BOP devices are not generally amenable to simple substitution of thermoplastics for the rubber sealing components.

Some patent literature shows BOPs which make use of thermoplastic materials, but these simply provide U-shaped thermoplastic seal inserts in the front face of a complicated BOP ram design, see for example U.S. Pat. No. 4,398,729, issued Aug. 16, 1983 to Bishop et al.; U.S. Pat. No. 5,127,623 issued Jul. 7, 1992 to McDugle; and U.S. Pat. No. 5,833,208 issued Nov. 10, 1998 to Lee, Jr. These types of BOP devices achieve a seal only by force applied to the seal from the front face against the polish rod.

It is an objective of the invention to provide an improved BOP with seals which, when used in combination with the BOP housing, are able to withstand both high pressure from below, and the environment of harsh chemical, while maintaining the seals over an acceptable time frame.

SUMMARY OF THE INVENTION

The present invention provides a BOP having a ram design that is capable of using thermoplastic seal materials such as polytetrafluoroethylene (PTFE), preferably modified with fillers such as carbongraphite or glass, which strengthen the polymers. For environments which expose the seal component to chemicals, the strengthened thermoplastic polymers are most preferred.

During designing and testing of the BOP of the present invention, it was discovered that thermoplastic materials could not simply be substituted into prior art ram-type BOP's such as shown in CA 2,260,655.

Each of the BOP rams of this invention include a body component, which together with a seal component form a full bore cylindrical ram which conforms to the horizontal ram bores of the BOP housing, for translating movement therein. The front end of the seal component provides a sealing face to seal against either the polish rod or the sealing face of an opposing ram. The front surface of each of the seal and body components is preferably formed with a vertical radial groove to seal against the polish rod. Most preferably, the sealing face of the seal component includes a cut-away portion such that a reduced area of the sealing face forms the seal to either the polish rod or the opposing ram.

Each of the seal and body components are formed with arcuate longitudinal outer surfaces for conforming with the horizontal bore. The body component is formed with a cut-out in its front portion to provide a seal support surface to support the seal component in both a vertical and horizontal direction. The cut-out and thus the seal support surface of the body component, along with the seal component, are shaped such that, in an assembled form but out of sealing engagement, the front end of the seal component protrudes beyond the front end of the body component. The seal component provides a sealing surface of thermoplastic material around its outer surface for sealing against the horizontal bore. This may be accomplished by forming the seal component from the thermoplastic material, such that its outer arcuate surface provides the sealing surface, or by providing an insert of thermoplastic material on the outer surface of the seal component. In sealing engagement, as the body component is advanced forwardly to contact either an adjacent ram or the polish rod to seal off the vertical bore, the seal component is pressed against the seal support surface of the body component such that the thermoplastic sealing surface is compressed outwardly to seal against the horizontal bore.

There are multiple ram designs to cause the thermoplastic sealing surface, in sealing engagement, to be compressed outwardly against the horizontal bore, but generally, this is accomplished by forming at least a portion of the seal support surface of the cut-out in the body component with an acutely angled surface (acute relative to the horizontal axis of the ram). Thus, in one preferred embodiment, the cut-out and seal component are both wedge shaped. In another embodiment the cut-out and seal component are generally L-shaped, with the horizontal support surface of the seal support surface being acutely angled such that, in sealing engagement the seal component moves rearwardly and upwardly on the angled support surface, closing an initial gap left between the body and seal components, and then compressing the thermoplastic sealing surface outwardly against the horizontal bore. In yet a further embodiment, the cut-out and seal component are again generally L-shaped, but with the seal support surface of the body component providing a horizontal support surface, which is generally parallel to the horizontal axis of the ram, and a rear support surface, which is rearwardly inclined relative to the vertical. In this latter embodiment, the seal component, when in sealing engagement, is pressed against the horizontal and rear support surfaces so as to compress the thermoplastic sealing surface outwardly against the horizontal bore.

The seal component provides a sealing surface formed of thermoplastic material around the arcuate outer surface for sealing against the horizontal bore. This thermoplastic sealing surface preferably includes a one or more raised ridge sealing surfaces formed of the thermoplastic material around the arcuate outer surface for sealing against the horizontal bore. These raised ridge sealing surfaces may include one or both of a peripheral ridge sealing surface, located at the peripheral edges of the seal component adjacent the body component, or a vertical bore raised ridge sealing surface, located at the front end of the seal component in the area which is exposed to the vertical bore when in a sealing engagement. The vertical bore raised ridge sealing surface may be either preformed by forming a reduced radius portion on the outer arcuate surface of the seal component, or by forming the raised ridge sealing surface in situ by sealing the ram against the vertical bore. The peripheral raised ridge sealing surface may be formed by forming a reduced radius portion on the outer arcuate surface of the seal component to form the peripheral raised ridge surface at its peripheral edges adjacent the body component.

In its assembled form (prior to forming a seal), the seal and body components are connected such that they have a staggered vertical alignment at their front surfaces, with the seal component protruding inwardly (toward the polish rod) beyond the body component. As well, in certain embodiments of the ram, in this assembled form, a gap is left between the body and seal components at the rear surface of the seal component, to allow the seal component to ride upwardly and rearwardly on the acutely angled surfaces of the body and seal components. The gap is sized to be less than the distance d by which the seal component protrudes beyond the body component at their front surfaces.

The seal component may be formed entirely of a thermoplastic material, with reduced radius portions being formed by milling so as to form the raised ridges for sealing. Alternatively, the seal component may be formed of steel with a peripheral groove to accommodate a thermoplastic seal insert to provide the raised ridge sealing surface.

In this manner, the sealing action as the ram is advanced toward the polish rod differs significantly from the prior art which sandwich a rubber type seal between ram retainer plates. In such prior art devices, the seal is energized in a squeezing action. The nature of the sealing action of the present invention is important to the use of thermoplastic sealing materials along the raised ridge sealing surface in a manner such that the ram seals both from the side against the polish rod (if present), and outwardly against the horizontal ram bores to effectively seal the vertical bore of the BOP housing against high pressure from below. In the present invention, as the ram is initially advanced in the ram bores, the protruding front surfaces of the seal components meet each other around the polish rod, causing the seal components to press against the seal support surface of the body component. Thereafter, further forward advancement of the ram pushes the seal component forward such that its protruding front surface seal around the polish rod. As well, the thermoplastic sealing surface of the seal component is compressed outwardly to seal against the wall of the horizontal ram bore.

The invention broadly provides a ram incorporating a thermoplastic seal for sealing in the horizontal bore of a wellhead production blowout preventer to close off the vertical bore of the well, the ram being adapted to seal at its front end against either a polish rod of a rod string, or against an adjacent ram. The invention also extends to a BOP including a pair of such rams, wherein each ram includes:

a body component with front and rear portions and ends;

a seal component with front and rear portions and ends;

said body component having an arcuate longitudinal outer surface for conforming with the horizontal bore surface, and having a cut-out in its front portion which provides a seal support surface to support the seal component in both a vertical and horizontal direction;

said seal component having an arcuate longitudinal outer surface for conforming with the horizontal bore surface, and an inner surface which generally conforms to the seal support surface of the body component;

said body component and seal component combining, in an assembled form, to form a full bore ram body, which when out of sealing engagement has the front end of the seal component protruding a horizontal distance d beyond the front end of the body component;

connectors for connecting the seal and body components while allowing the seal component, during sealing engagement, to be pressed against the seal support surface of the body component; and said seal component providing a sealing surface formed of thermoplastic material around the arcuate outer surface for sealing against the horizontal bore;

so that, as the body component is advanced forwardly into a sealing engagement causing the front end of the seal component to contact either the adjacent ram or the polish rod to seal off the vertical bore, the seal component is pressed against the seal support surface of the body component such that the thermoplastic sealing surface is compressed outwardly to seal against the horizontal bore.

It should be understood that the terms "inner", "outer", "front" and "rear", as used herein and in the claims with reference to the BOP ram or its parts, refer to the ram as it is designed to be positioned in one of the horizontal bores, for movement forwardly or rearwardly into the vertical bore. By "inner" or "front", as used herein, is meant the portion or end of the ram or its parts at the vertical bore. By "rear" is meant the portion or end of the ram or its parts opposite the front. By "outer" is meant the outer cylindrical portion of the ram or its parts. An "outwardly" motion is meant to refer to an outward movement (including a rearward and upward motion) of the thermoplastic sealing surface against the horizontal cylindrical bore, so as to seal against the horizontal bore.

BRIEF DESCRIPTION OF THE DRAWINGS

FIGS. 1–5 show a first embodiment of the present invention, in which:

FIG. 1 is a side sectional view of a production blowout preventer of this invention with one of the rams in a sealing position around the polish rod;

FIG. 2 is a perspective exploded view of the body and seal components of the rams of FIG. 1;

FIG. 3 is an exploded side view of the steel body and seal component of the ram of FIG. 2, showing in dotted outline the profiles of the bores for the connecting pins;

FIG. 4 is a side view of the ram as shown in FIG. 3, but in an assembled state, showing in dotted outline the connecting and locking pins and the bores for same; and FIG. 5 is a perspective view of the ram, in assembled form, as shown in FIG. 4.

FIGS. 6–11 show a second embodiment of the invention in which screws are used to connect the steel body and seal component, in which:

FIG. 6 is a perspective exploded view of the ram from the seal end;

FIG. 7 is a perspective exploded view of the ram from the steel body end;

FIG. 8 is a perspective assembled view of the ram from the steel body end;

FIG. 9 is a perspective assembled view of the ram from the seal end;

FIG. 10 is perspective, partially cut away view of the ram sealing around the polish rod in the production blowout preventer fitted with hydraulic actuators, taken from a top angle; and FIG. 11 is a perspective, partially cut away view of the ram sealing around the polish rod in the production blowout preventer fitted with hydraulic actuators, taken from a side angle.

FIGS. 12–16 show a third embodiment of the invention in which the seal component is generally shaped as in the first and second embodiments, but is formed in two parts such that the thermoplastic seal is a seal insert providing all of the sealing surfaces around the periphery of a steel ram insert, in which:

FIG. 12 is a perspective, exploded view of the ram from the steel body end;

FIG. 13 is an exploded side view of the steel body and seal component of the ram of FIG. 12, showing in dotted outline the profiles of the bores for the connecting screws;

FIG. 14 is a side view of the ram as shown in FIG. 13, but in an assembled state, showing in dotted outline the connecting screw and the bores for same;

FIG. 15 is a perspective view of the ram, in assembled form, as shown in FIG. 14; and FIG. 16 is a side sectional view of the ram, illustrating the two part construction of the seal component, with the seal insert providing the sealing surfaces around the periphery of the steel ram insert.

FIGS. 17–19 show a fourth embodiment of the invention in which the body component is formed in two parts—a rear plate portion and a front wedge portion, in which:

FIG. 17 is a perspective, exploded view of the ram from the body component end;

FIG. 18 is an exploded side view of the ram of FIG. 17, showing in dotted outline the profiles of the bores for the connecting pins; and FIG. 19 is a side sectional view of the ram in assembled form, showing in dotted outline the profiles of the bores and connecting pins.

FIGS. 20–22 show a fifth embodiment of the invention for use in a BOP when the polish rod is removed from the well, such that the front surfaces of the rams seal against each other, in which:

FIG. 20 is a perspective view of the ram in assembled form from the front seal component end;

FIG. 21 is an exploded side view of the ram of FIG. 20, showing in dotted outline the profiles of the bores for the connecting pins; and FIG. 22 is a side sectional view of the ram of FIG. 20 in assembled form, showing in dotted outline the profiles of the bores and connecting pins.

FIGS. 23–25 show a sixth embodiment of the invention, wherein the body component is in two parts, as shown in the fourth embodiment, and wherein the seal component is formed in two parts—a lower wedge portion which provides the lower angled surface, and an upper seal portion, in which:

FIG. 23 is an exploded perspective view of the ram from the body component end;

FIG. 24 is an exploded side sectional view of the ram, showing the bores and pins in dotted outline; and FIG. 25 is an assembled side sectional view showing the bores and pins in dotted outline.

FIGS. 26–32 show seven further embodiments of the ram of this invention, each ram being shown in a perspective view, in an assembled form, in which:

FIG. 26 shows the seal component generally shaped as in the first embodiment, without the preformed peripheral raised ridge sealing surface;

FIG. 27 shows the seal component generally shaped as in FIG. 26, but including a cut-away portion in the front sealing face, to increase the sealing efficiency;

FIG. 28 shows the seal component generally shaped as in FIG. 1 to include the peripheral raised ridge sealing surface, but also including the cut-away portion in the sealing face;

FIG. 29 shows the seal component generally shaped as in FIG. 27, but wherein the cut-away portion in the sealing face extends across the vertical radial groove;

FIG. 30 shows the seal component is generally shaped as in FIG. 1, but also including the cut-away portion in the front sealing surface as in FIG. 29;

FIG. 31 shows the seal component generally shaped as in FIG. 27, but including a vertical bore raised ridge sealing surface at the front of the ram to seal vertically against the vertical bore; and FIG. 32 shows the seal component generally shaped as in FIG. 28, but including both the vertical bore and peripheral raised ridge sealing surfaces at the front and rear of the ram respectively, to seal against both the vertical and horizontal bores.

FIG. 33 is a perspective view of the ram in an exploded, unassembled form; and FIG. 34 is an exploded side sectional view of the ram in an unassembled form, showing the connectors and the shape of the cut-out portion of the body component.

DESCRIPTION OF THE PREFERRED EMBODIMENTS

Figure 1:
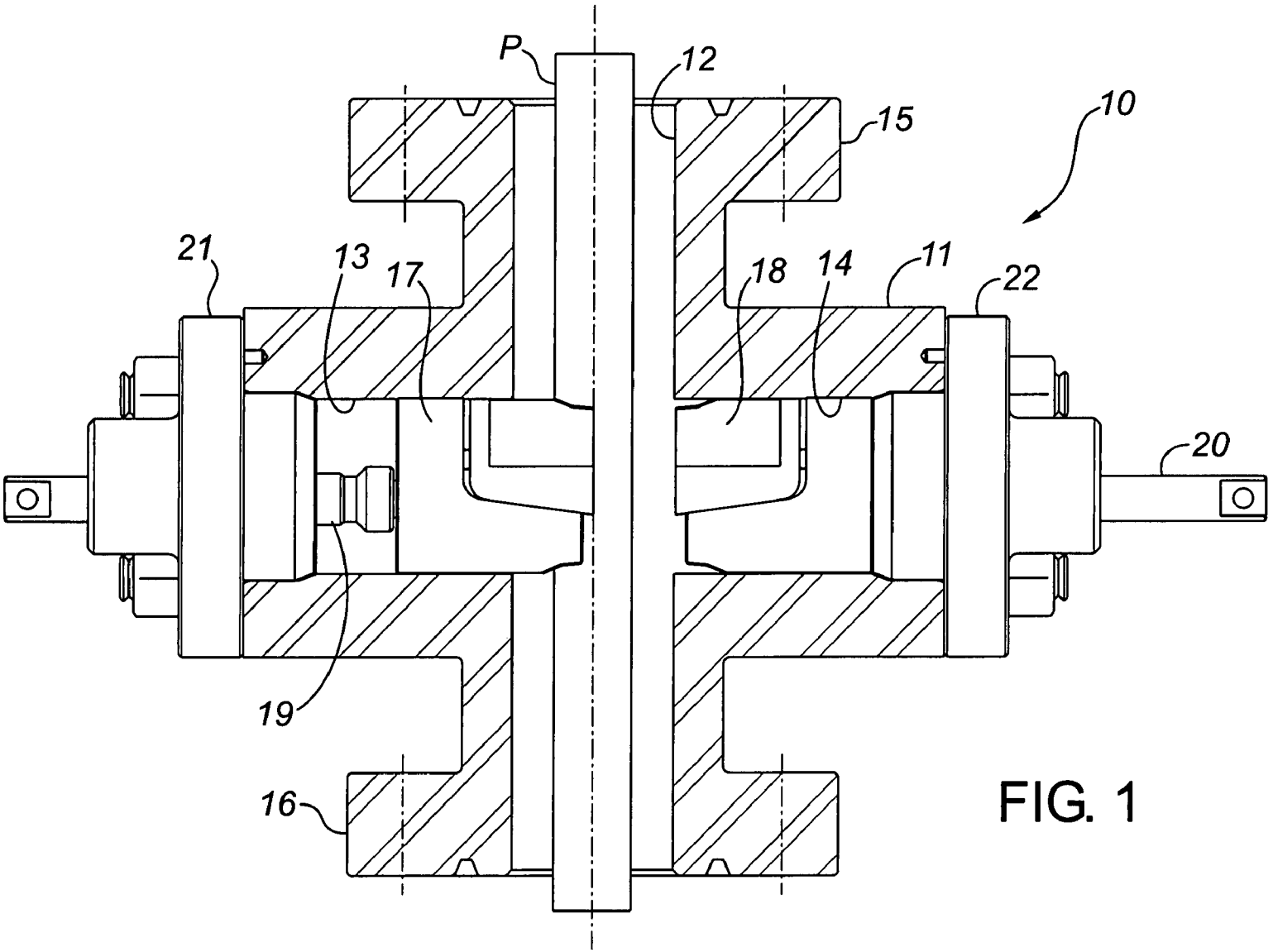

Multiple preferred embodiments of the BOP ram of the present invention are shown in the Figures, with like parts being labeled with the same reference numerals. Having reference to FIG. 1 of the first embodiment, and FIGS. 10 and 11 of the second embodiment, the production blowout preventer (BOP) is shown generally at 10, to include a cross-shaped housing 11 forming a vertical bore 12 and a pair of co-axial horizontal ram bores 13, 14. Top and bottom flange connections 15, 16 to wellhead components located above and below the BOP 10 are shown, although alternate connections such as threaded connections might be used. The horizontal ram bores 13, 14 intersect with the vertical bore 12. The polish rod P is shown in place in the vertical bore 12.

Figure 10:
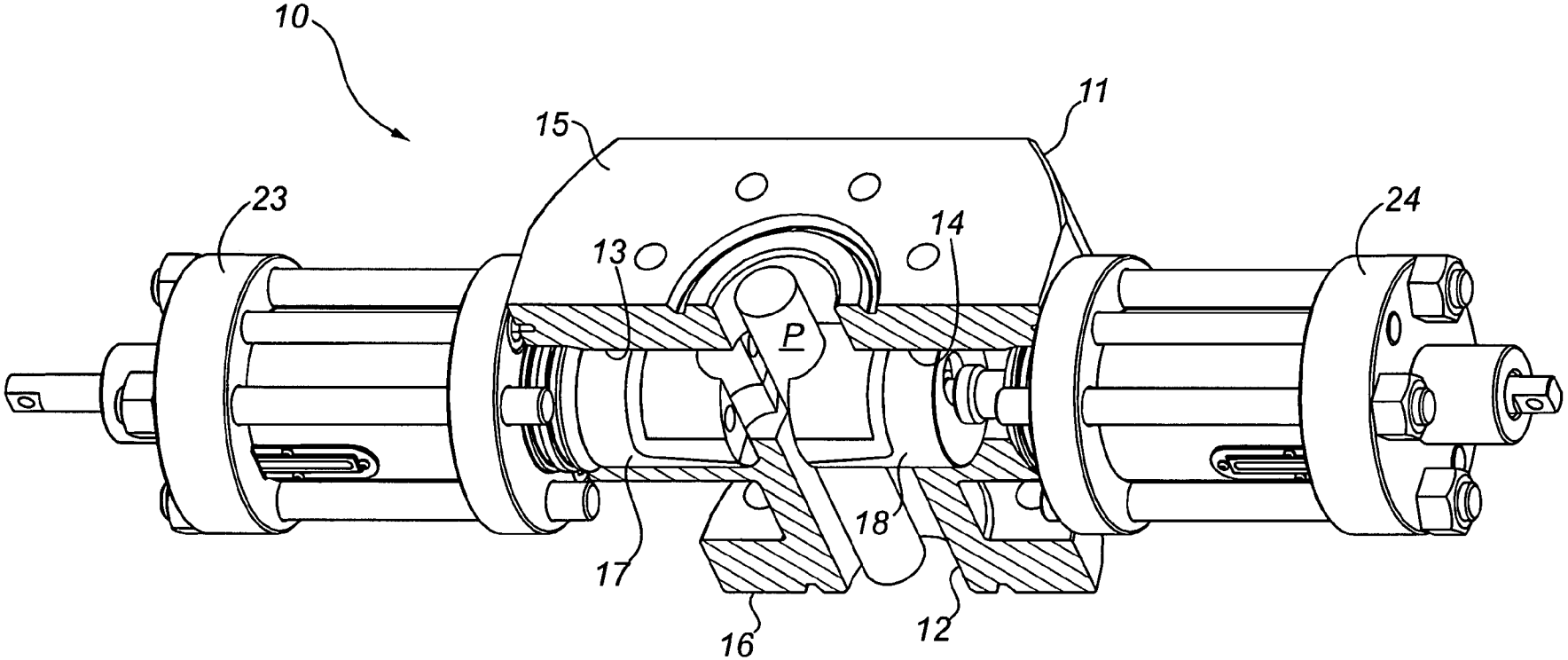
Figure 11:
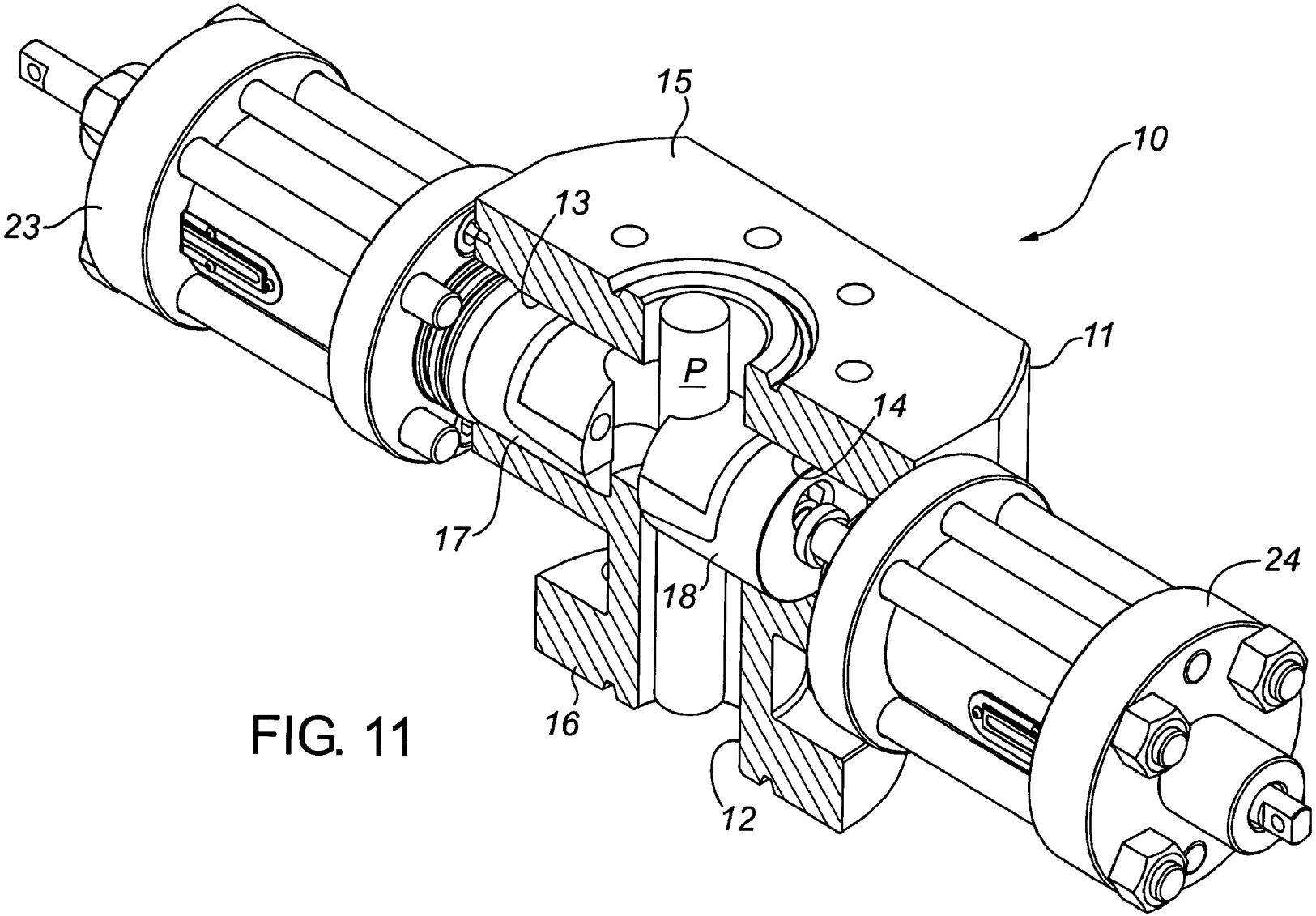
Figure 12:
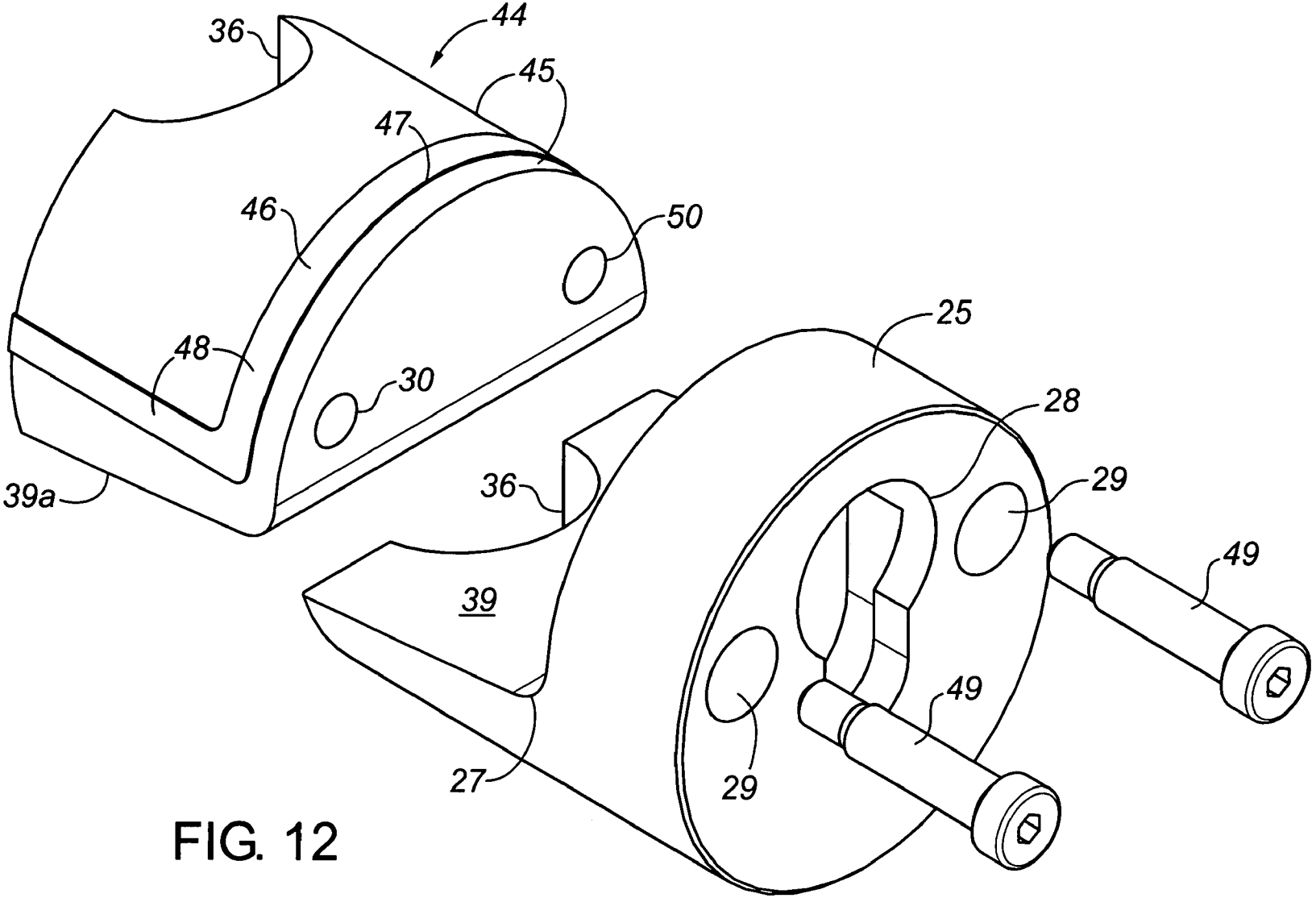
Figure 13:
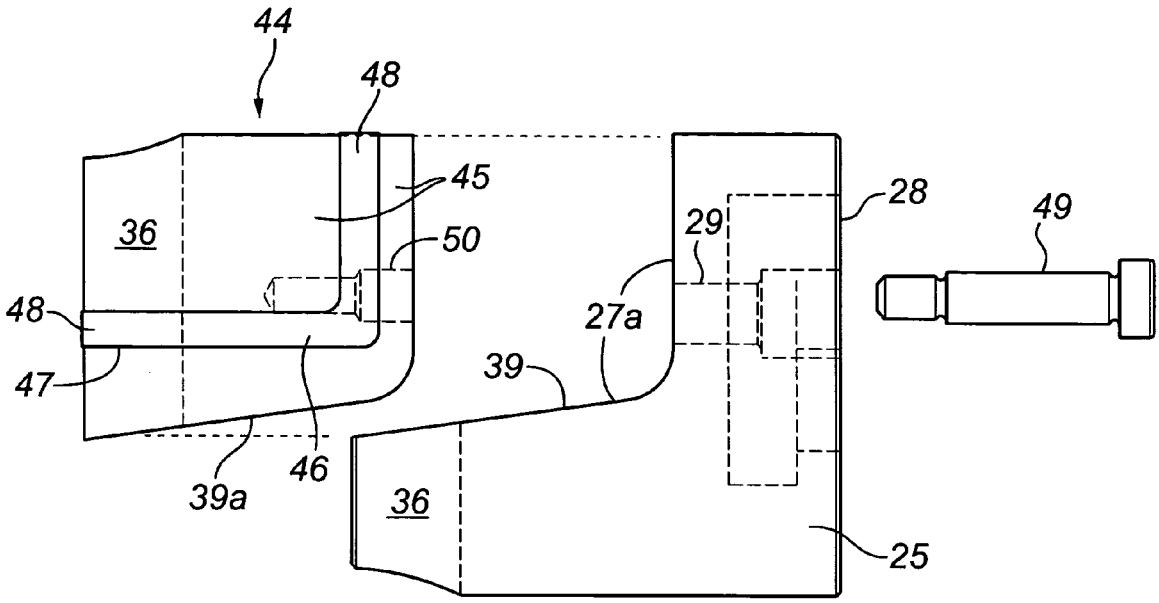
Figure 14:
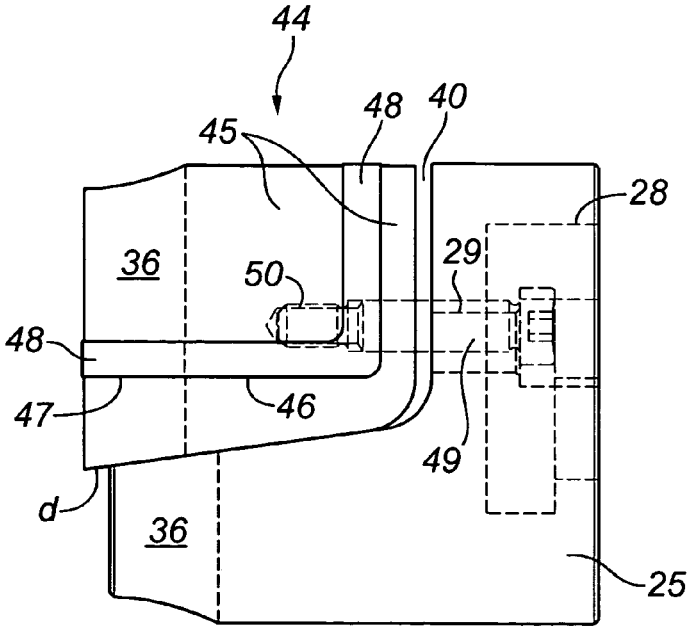
Figure 15:
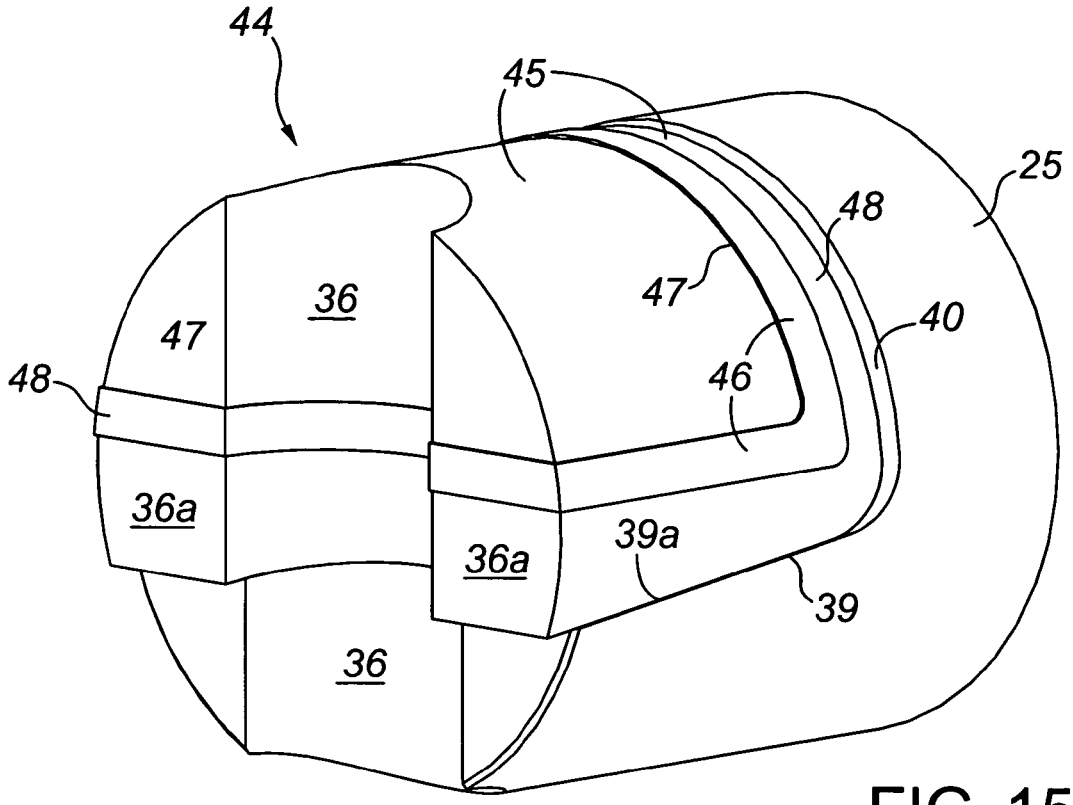
Figure 16:
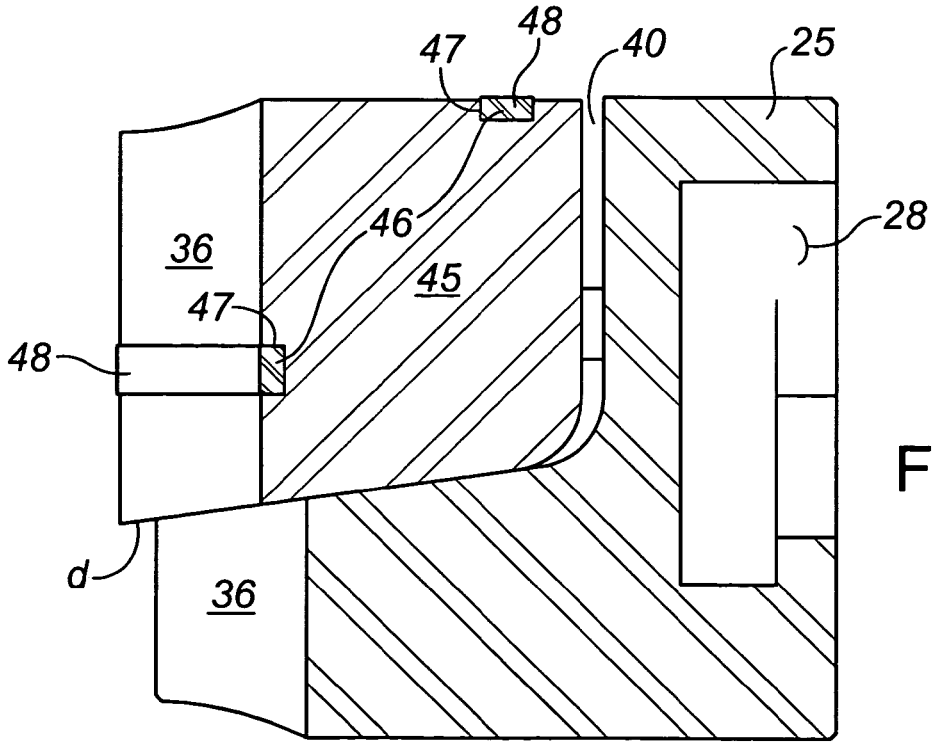

The generally cylindrical rams 17, 18 of the BOP 10 are shown in the Figures to be of generally two piece construction, which when assembled are generally cylindrically shaped in order to seal in the ram bores 13, 14. The rams 17, 18 are locked onto the ends of ram screws 19, 20, which extend through end plugs 21, 22 at the outer ends of the ram bores 13, 14. The ram screws 19, 20 can be turned to advance or retract the rams 17, 18 into or out of the vertical bore 12 with mechanical screw jacks (not shown), or as shown in FIGS. 10 and 11, the ram screws 19, 20 can be advanced and retracted with hydraulic actuators 23, 24.

Each of the rams 17, 18 are shown to consist of a body component 25 and a seal component 26, which, in an assembled form, are generally cylindrical in shape for a tight fitting seal in the ram bores 13, 14. The seal component 26 is shaped to fit into a cut-out 27 at the front of the body component 25. The cut-out 27 provides a seal support surface 27*a* to support the seal component 26 in both a vertical and horizontal direction. The cut-out portion 27 is generally L-shaped, as shown in FIGS. 1–34. However, as shown in FIG. 35, the cut-out portion may have an alternate shape, such as a wedge shape. The rear of the body component 25 is formed with a central T-slot 28 to fit and lock onto the ends of each of the ram screws 19, 20. The body component 25 is generally formed from a metal such as steel. The seal component 26 is formed to provide a sealing surface of thermoplastic material to seal against the horizontal bore. The seal component 26 is formed either entirely from, or so as to carry a sealing material such as an insert of, a thermoplastic material, most preferably PTFE with carbongraphite or glass fillers, in order to withstand the chemicals used in well production.

Figure 2:
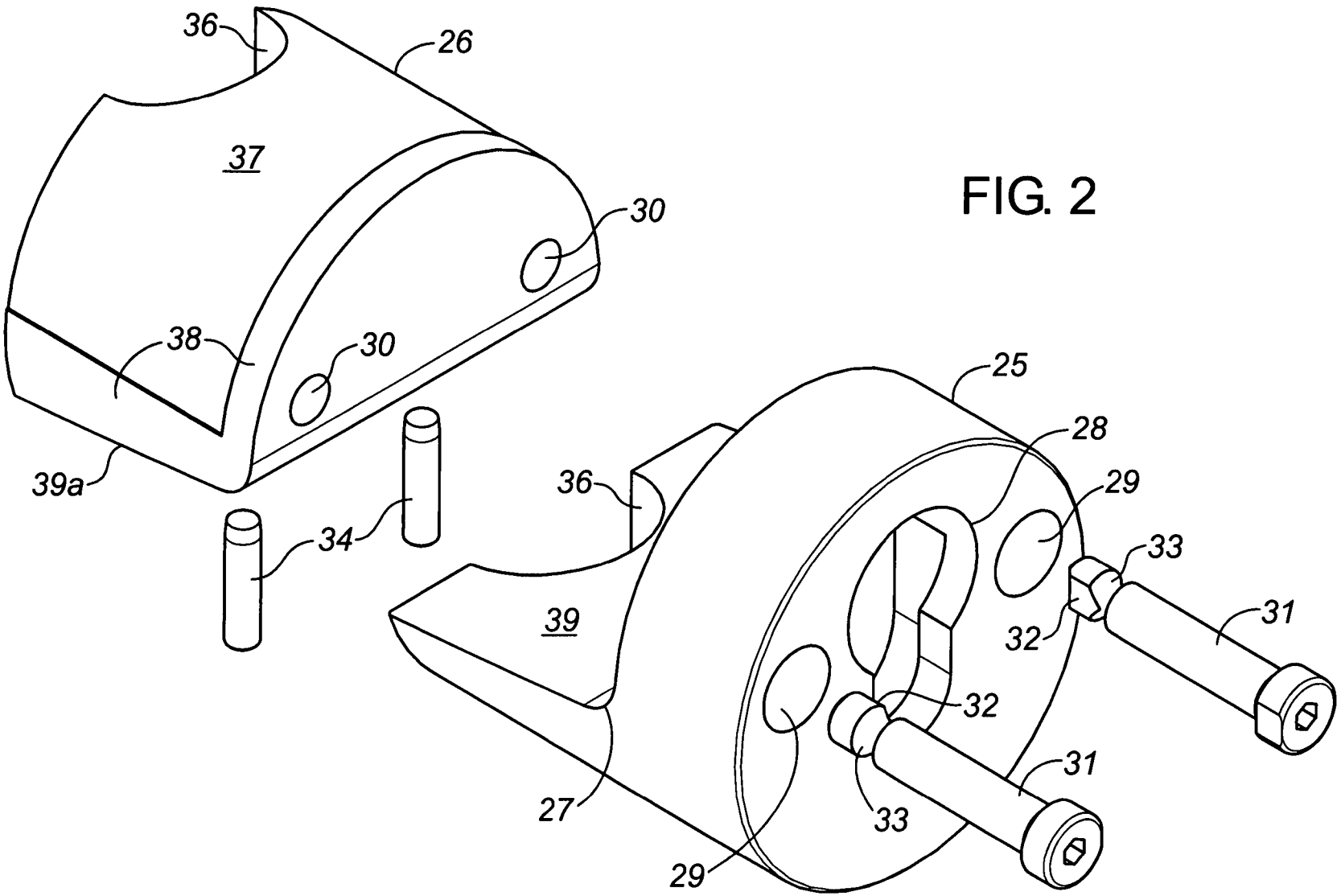
Figure 3:
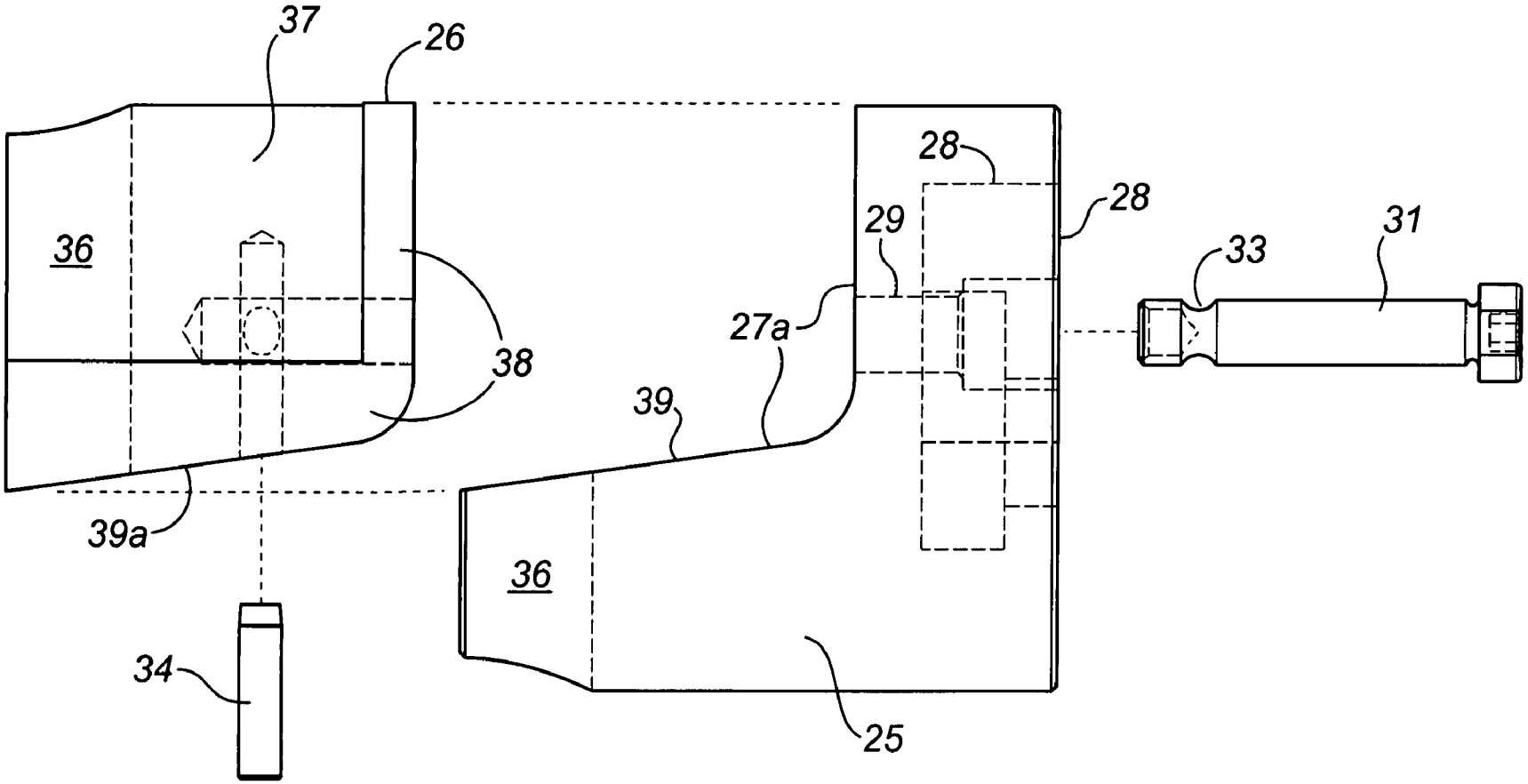
Figure 4:
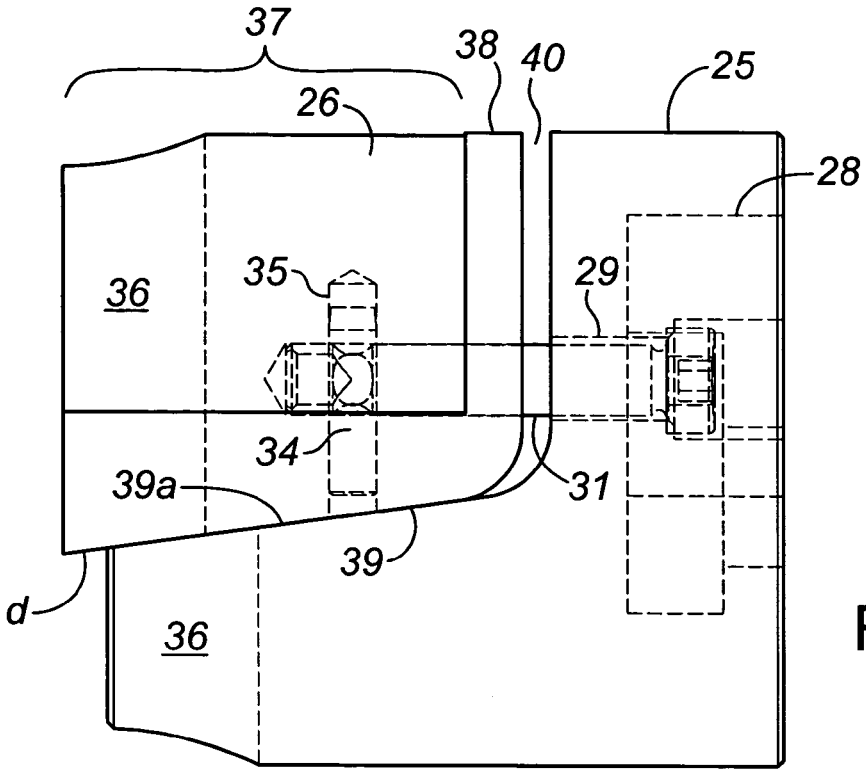

In FIGS. 1–5, each of the body and seal components 25, 26 are formed with a pair of aligned horizontal pin bores 29, 30 respectively, to accommodate a pair of connecting pins 31. The design of the connecting pins 31 is best seen in FIG. 2, in which milled out portions 32 on the inner ends of the pins 31 and circumferential grooves 33 allow for locking into place with locking pins 34 located in vertical bores 35 formed in the seal component 26.

Each of the body and seal components 25, 26 is preferably formed with a vertical radial groove 36 that runs along the front of the assembled ram to accommodate and seal against the polish rod P. The vertical radial groove 36 is optional as the rams 17, 18 may be formed such that the front sealing surface 36*a* of the seal component 26 seals against the sealing surface 36*a* of the opposing ram in embodiments where the polish rod P is not present. Importantly, in its assembled connected form with the body component 26, the front of the seal component 26 protrudes beyond the front of the body component (see FIGS. 4 and 5).

The seal component 26 is generally semi-cylindrical in shape such that, when connected to the body component 25, the ram is full bore conforming to the horizontal ram bores 13, 14. In the first embodiment, the seal component 26 is shown formed with a reduced radius portion 37 at its outer circumference, forming a peripheral raised ridge sealing surface 38 along its outer peripheral (back and bottom) edges. As best explained below, when the rams 17, 18 are advanced into a closed position against the polish rod P, this peripheral raised ridge sealing surface 38 encircles the vertical bore 12 and thus functions to seal the vertical bore 12 when the rams 17, 18 are fully engaged (best seen in FIGS. 1, 10 and 11, in which one of the rams is shown engaged against the polish rod P).

Figure 5:
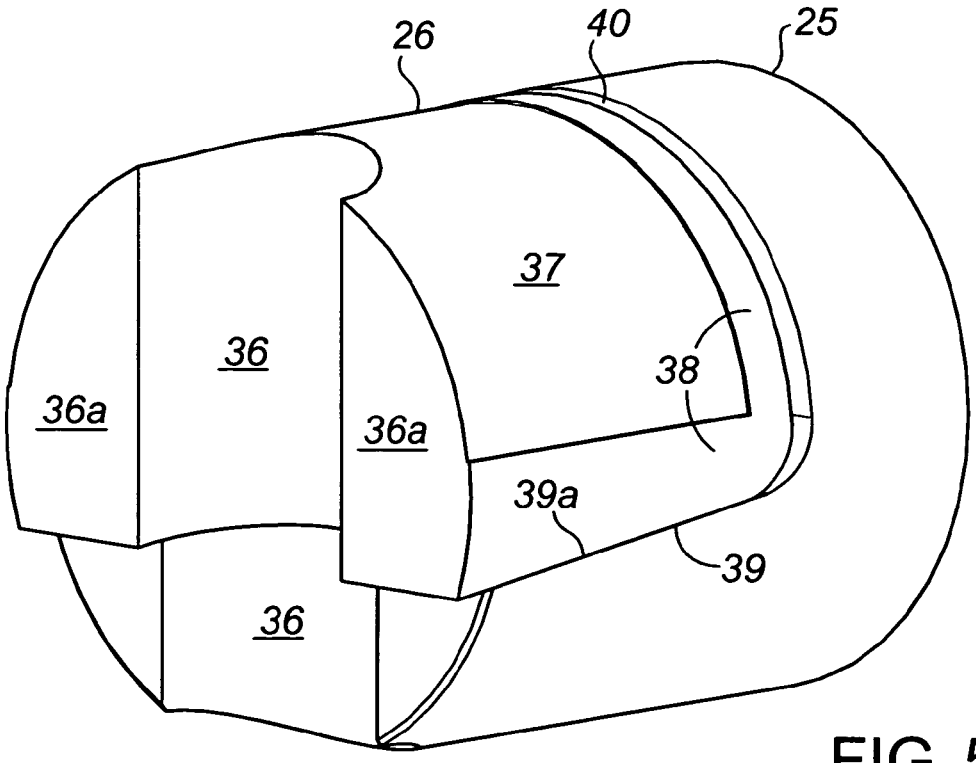
Figure 8:
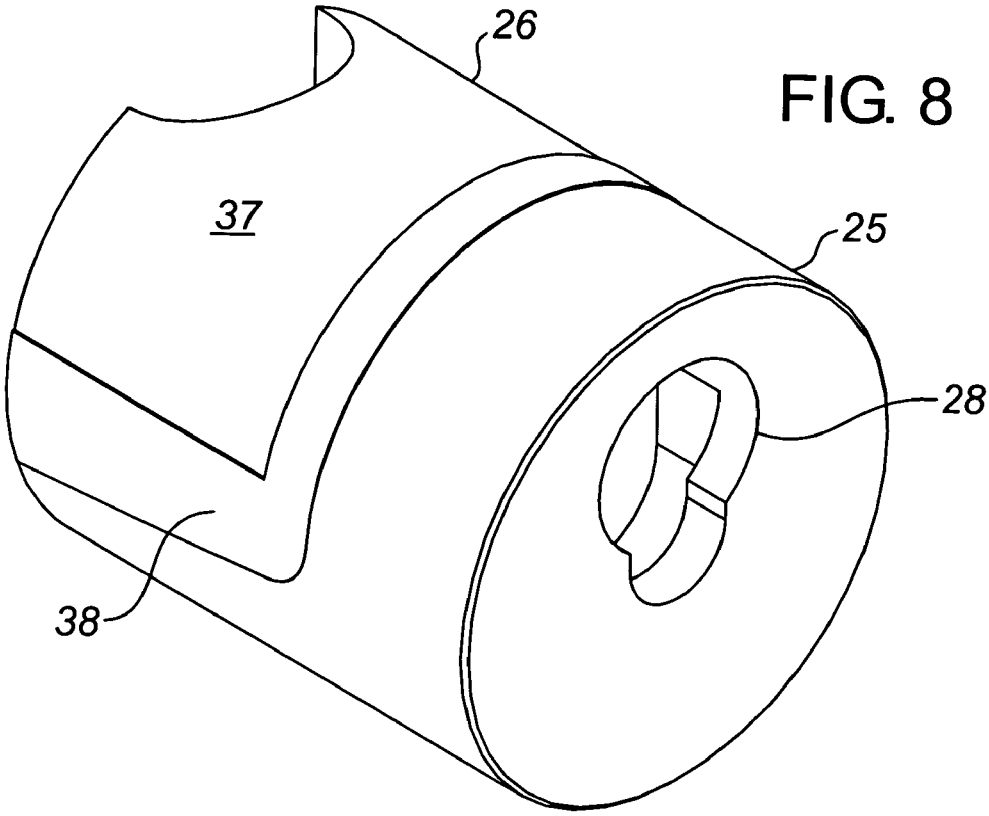
Figure 9:
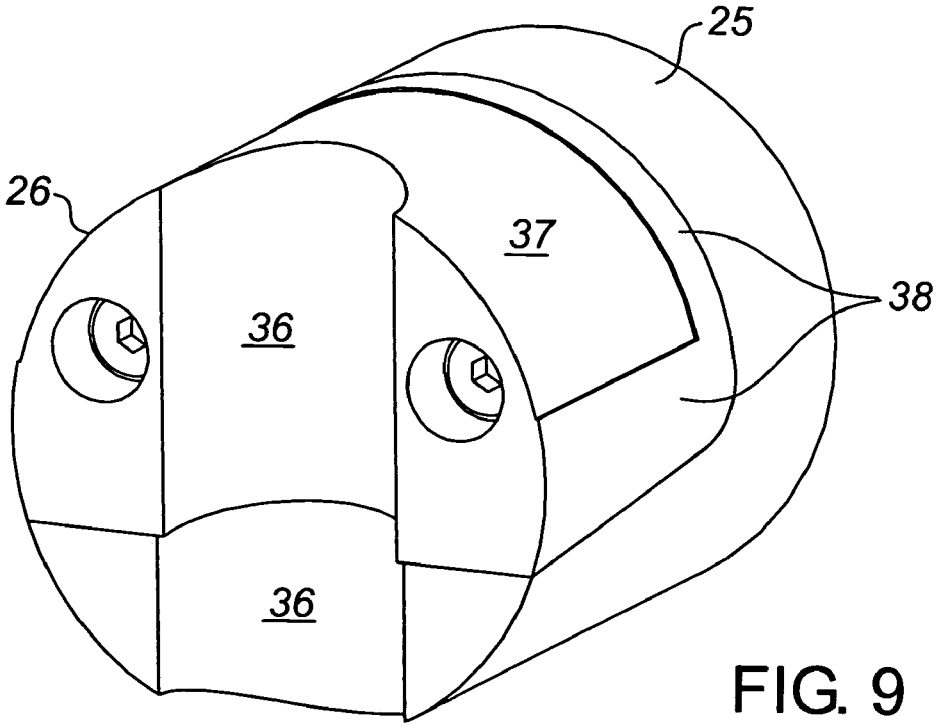

The L-shaped cut-out 27 of the body component 25 as shown in FIGS. 1–5 is formed with a slightly inclined (front to rear) acutely angled surface 39. A similarly angled lower surface 39*a* is formed on the seal component 26, such that during sealing action, the seal component 26 rides upwardly and rearwardly on the surface 39 of the body component 25, as the rams 17, 18 are advanced to close the vertical bore 12. As best seen in FIG. 5, in its assembled, connected state, the seal component 26 is seated in the L-shaped cut-out 27, and a gap 40 remains at the rear of the seal component between the components 25, 26. As well, the seal component 26 protrudes at its front surface beyond the front end of the body component 25. The horizontal distance by which the front surface of the seal component 26 protrudes beyond the body component 25 is greater than the horizontal width of the gap 40. These relative dimensions are important to the sealing action of the rams, as described below.

The nature of the sealing action of the present invention is important to the use of thermoplastic sealing materials along the peripheral raised ridge sealing surface 38 in a manner such that the rams 17, 18 seal both from the side against the polish rod P, and outwardly against the horizontal ram bores 13, 14 to effectively seal the vertical bore 12 of the BOP housing against high pressure from below. As the rams 17, 18 are initially advanced in the ram bores 13, 14, the protruding front surfaces of the seal components 26 meet each other around the polish rod P, causing the seal components 26 to ride upwardly and rearwardly on the acutely angled surfaces 39 of the body components 25, until the gaps 40 between the seal and body components 25, 26 are closed, and the seal component is pressed against the seal support surface 27*a*. Thereafter, further forward advancement of the rams 17, 18 pushes the seal components 26 forward such that their protruding front surfaces seal around the polish rod P. As well, the peripheral raised ridge sealing surfaces 38 of the seal components 26 are pushed outwardly (upwardly and forwardly on the body component 25) to seal against the walls of the horizontal ram bores 13, 14.

In the second embodiment of the invention shown in FIGS. 6–11, the body and seal components 25, 26 are formed and shaped as described above, however the seal component 26 is formed with a pair of horizontal bores 41, which extend therethrough, and which align with a pair of threaded bores 42 in the body component 25. Two socket head cap screws 43 are threaded at one end to make a threaded connection to the threaded bores 42, and thus to connect the body and seal components 25, 26.

In the third embodiment of the invention shown in FIGS. 12–16, the rams 17, 18 are formed of a steel body component 25 shaped and formed as described above, with like parts being labeled with the same reference numerals. However, the seal component, labeled as 44, is formed of a steel ram insert 45 and a seal insert 46, with the seal insert 46 most preferably being formed of a thermoplastic sealing material such as PTFE with carbongraphite or glass fillers, as set out above. As best seen in cross section in FIG. 16, the seal insert 46 is held, for example by bonding, in a groove 47 which extends generally around the outer periphery of the ram insert 45, providing a peripheral raised ridge sealing surface 48 which seals against the vertical bore 12 in the same manner as described above. Because the ram insert 45 is formed of steel, the connecting screws 49 of this embodiment are threaded at their ends to form a threaded connection with threaded bores 50 in the ram insert 45.

Figure 17:
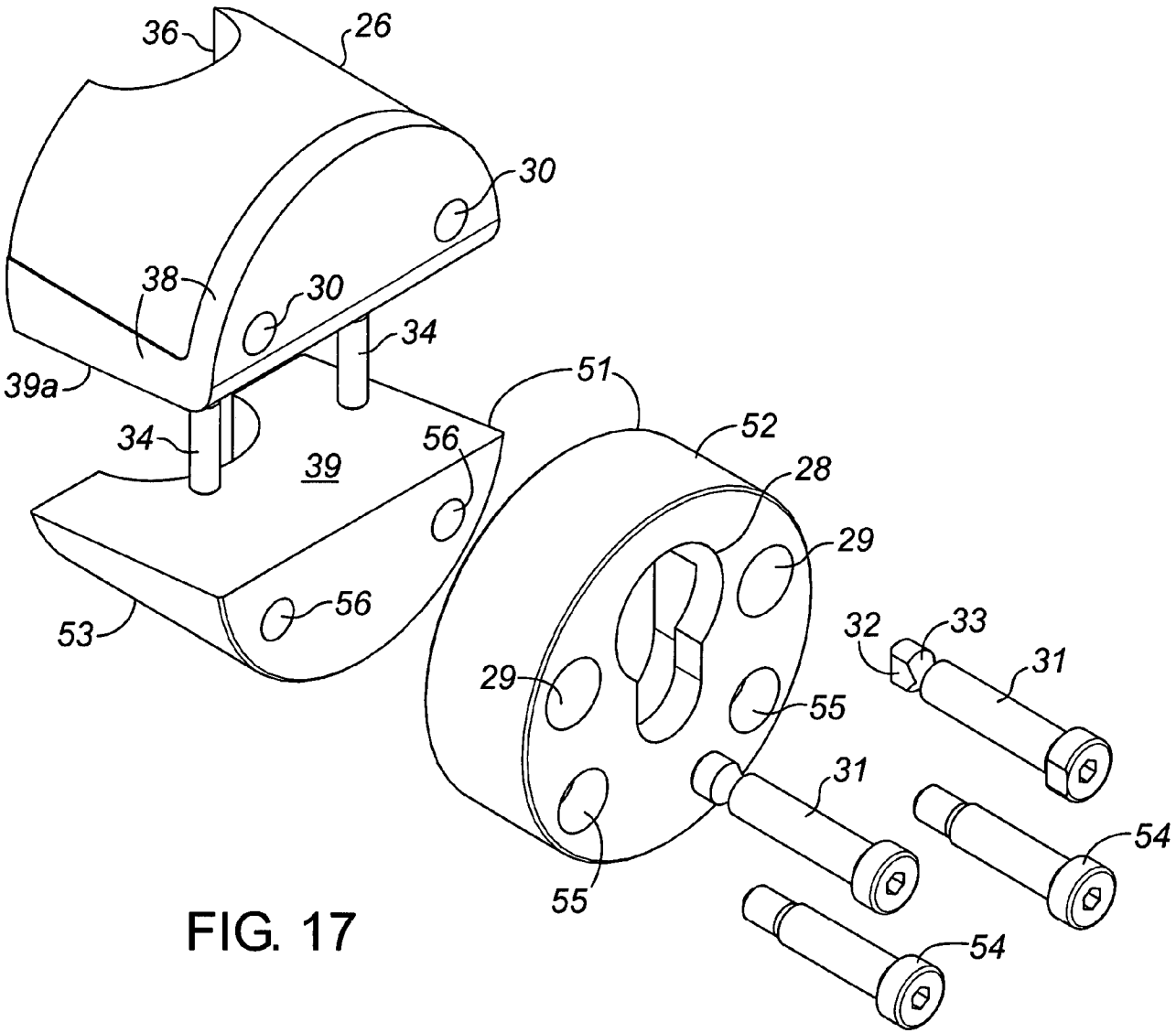
Figure 18:
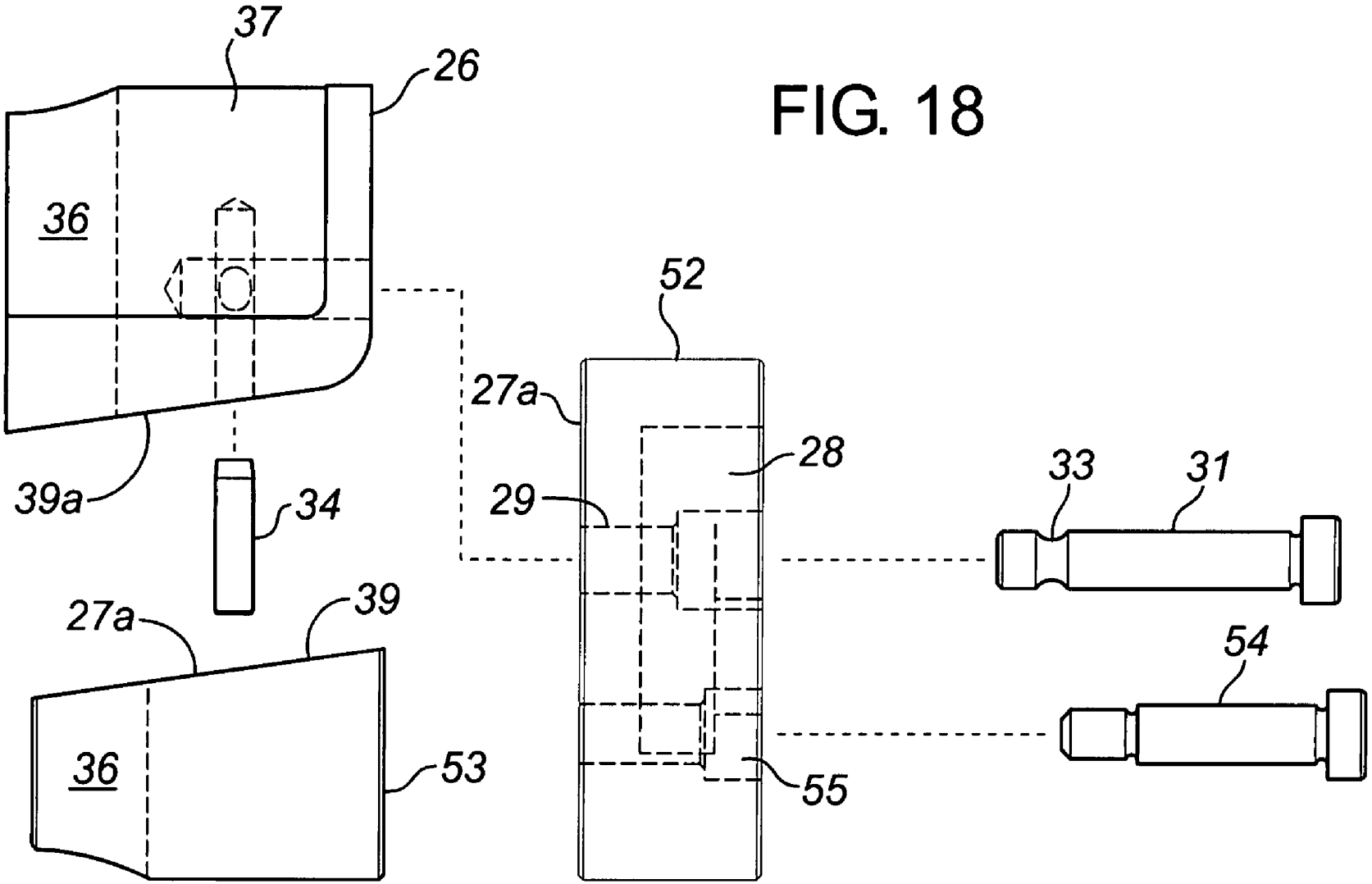
Figure 19:
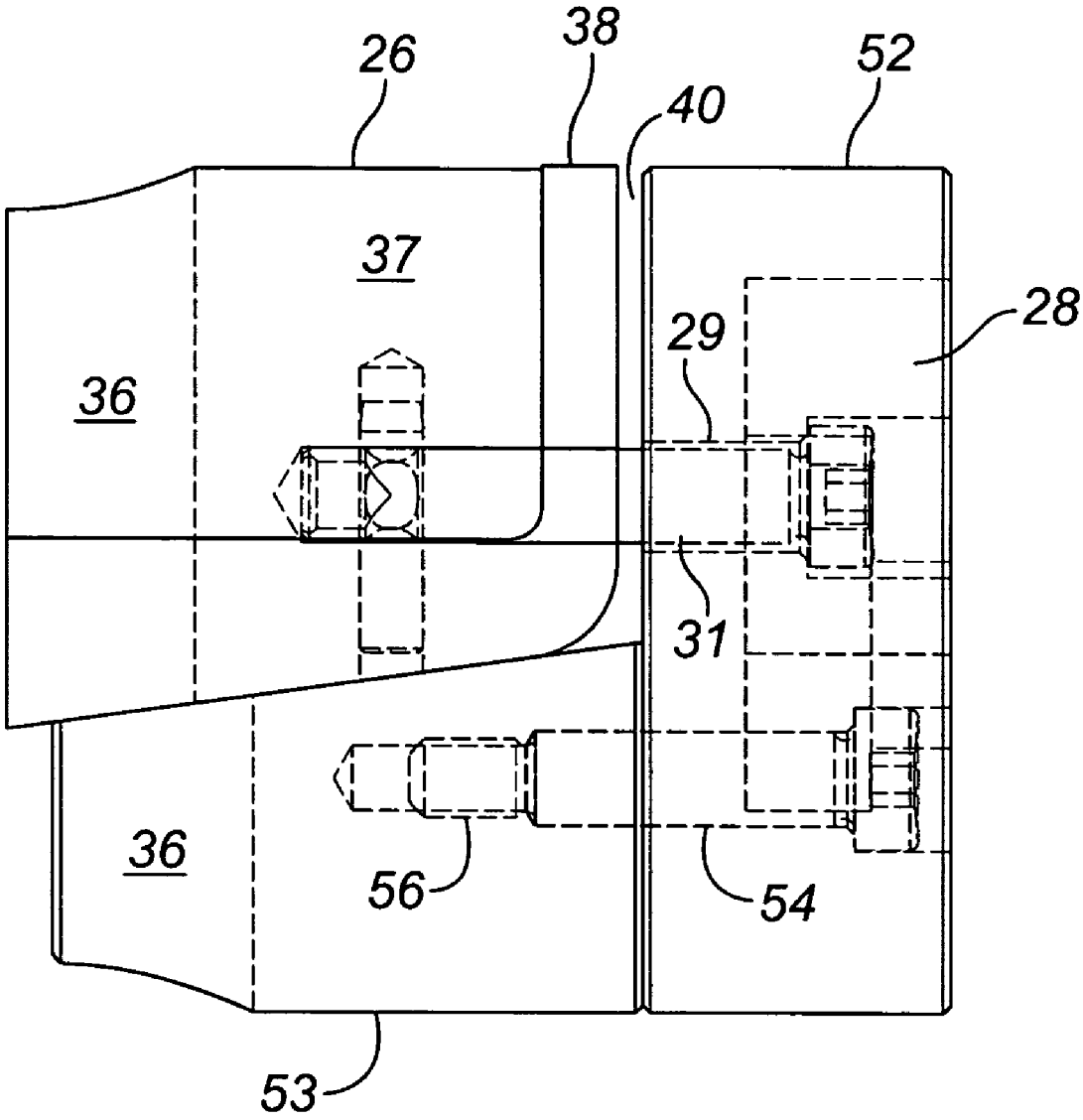

In the fourth embodiment of the invention shown in FIGS. 17–19, the rams 17, 18 are formed of a two-piece steel body component labeled as 51, which in assembled form, provide the same L-shape as described above. The seal component, labeled as 26, is identical to that described above for the first embodiment, and thus like parts are labeled with the same reference numbers. The steel body component 51 includes a rear plate portion 52 and a front wedge portion 53, which are connected together with threaded cap screws 54 which extend through horizontal bores 55 in the plate portion and into threaded bores 56 in the wedge portion. The seal component 26 is connected to the assembled steel body portion in the same manner as for the first embodiment with connecting pins 31 and locking pins 34.

Figure 20:
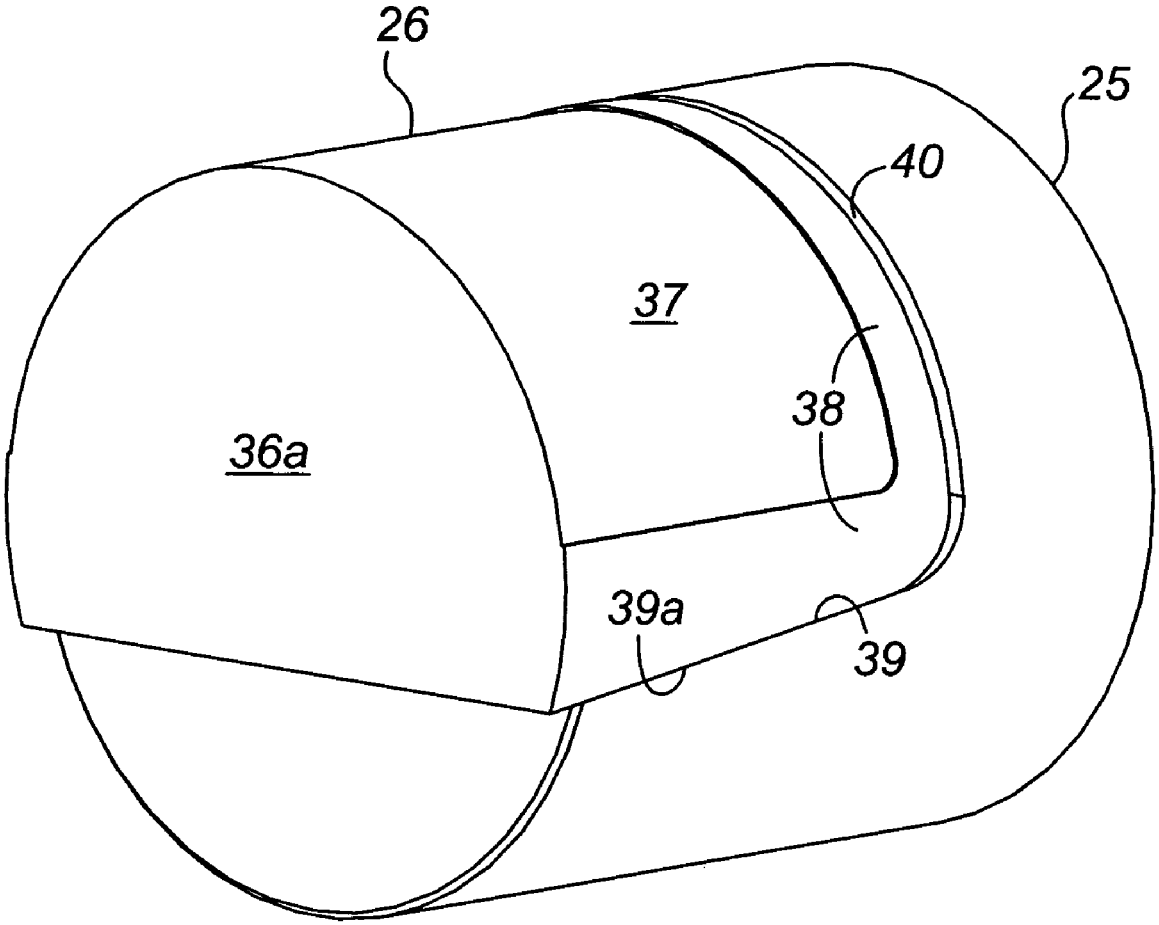
Figure 21:
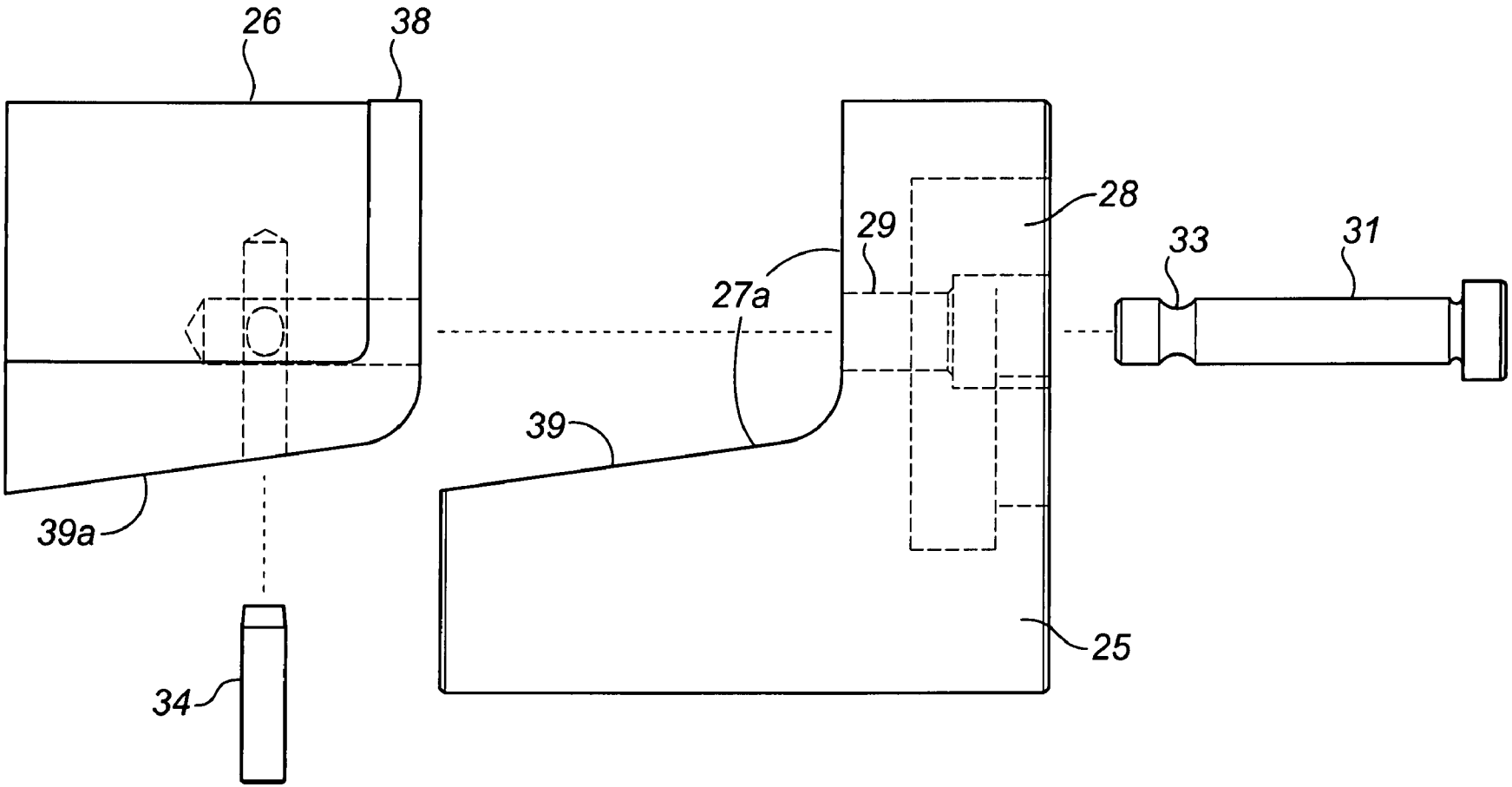
Figure 22:
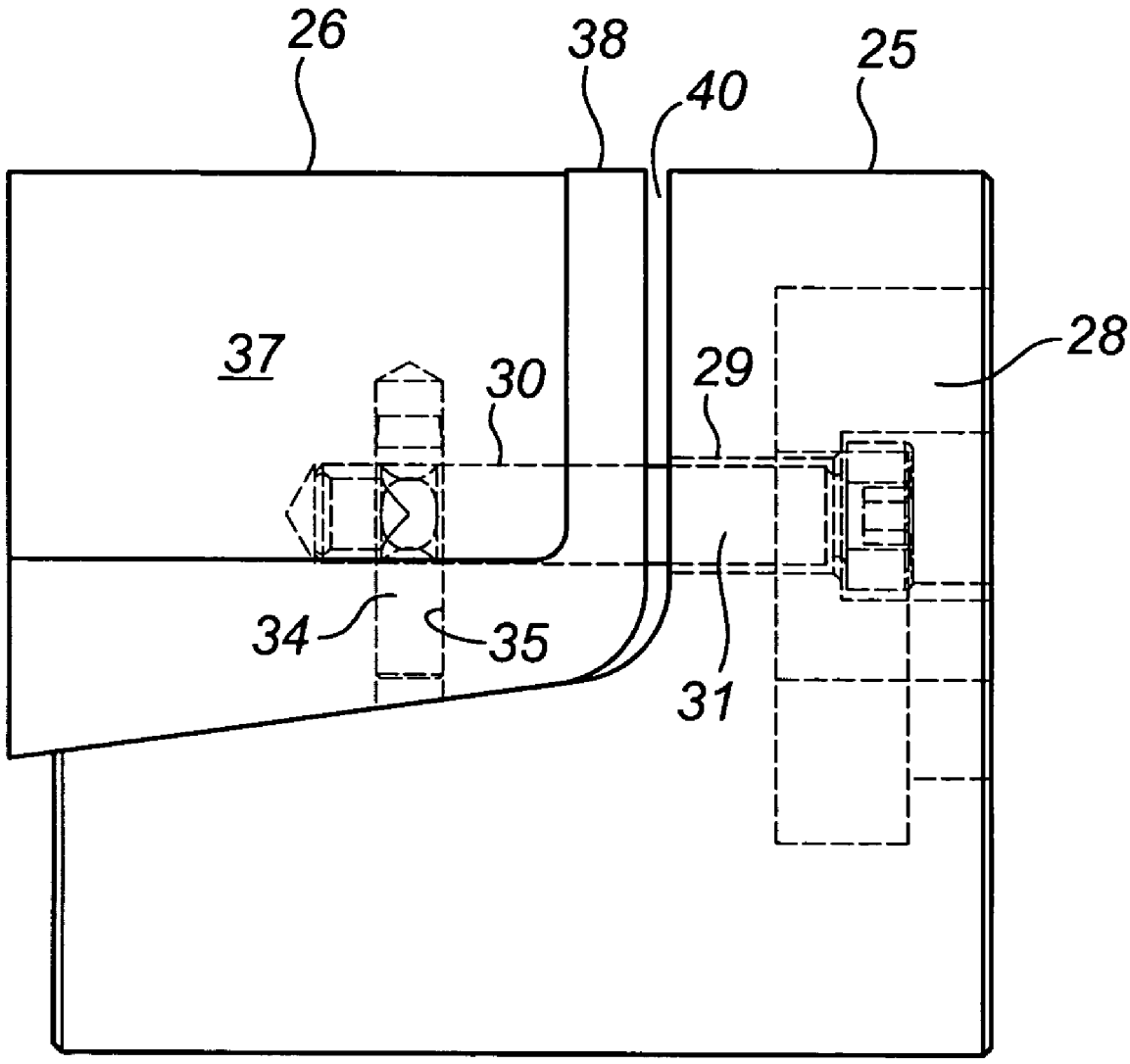

In the fifth embodiment of the invention shown in FIGS. 20–22, the rams 17, 18 are identical to the first embodiment, except that the vertical radial groove 36 is not formed in the front of the body and seal components 25, 26. All other like parts are labeled with the same reference numbers as in FIGS. 1–5. These rams 17, 18 have utility when the polish rod is removed from the well, and thus the front surfaces of the seal component 26 seal against each other across the vertical bore 12. The sealing action of this embodiment is as described above, except that protruding front surfaces of the seal components 26 seal against each other instead of the polish rod. It should be understood that any of the other embodiments of this invention could likewise be formed without the vertical radial groove.

Figure 23:
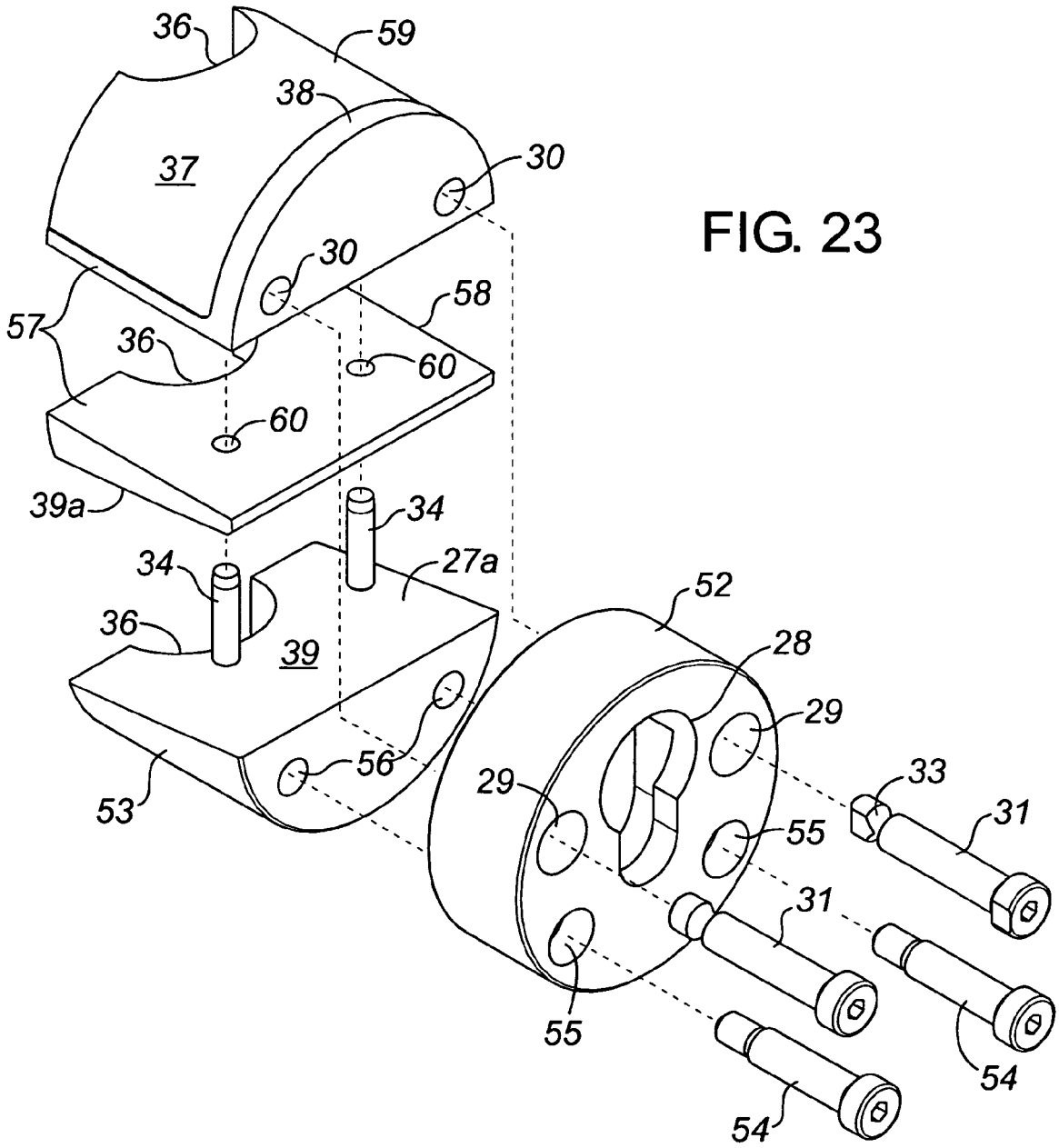
Figure 24:
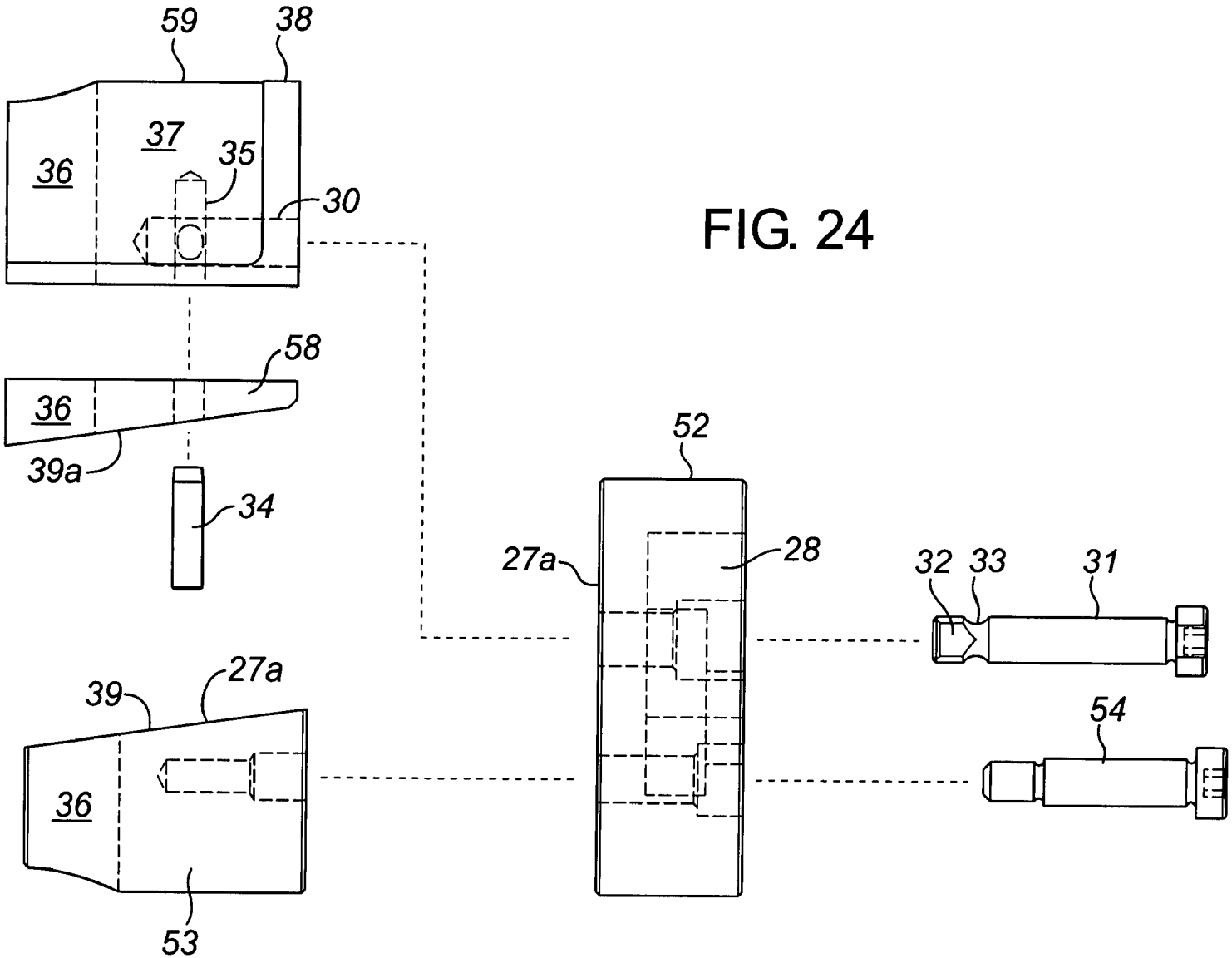
Figure 25:
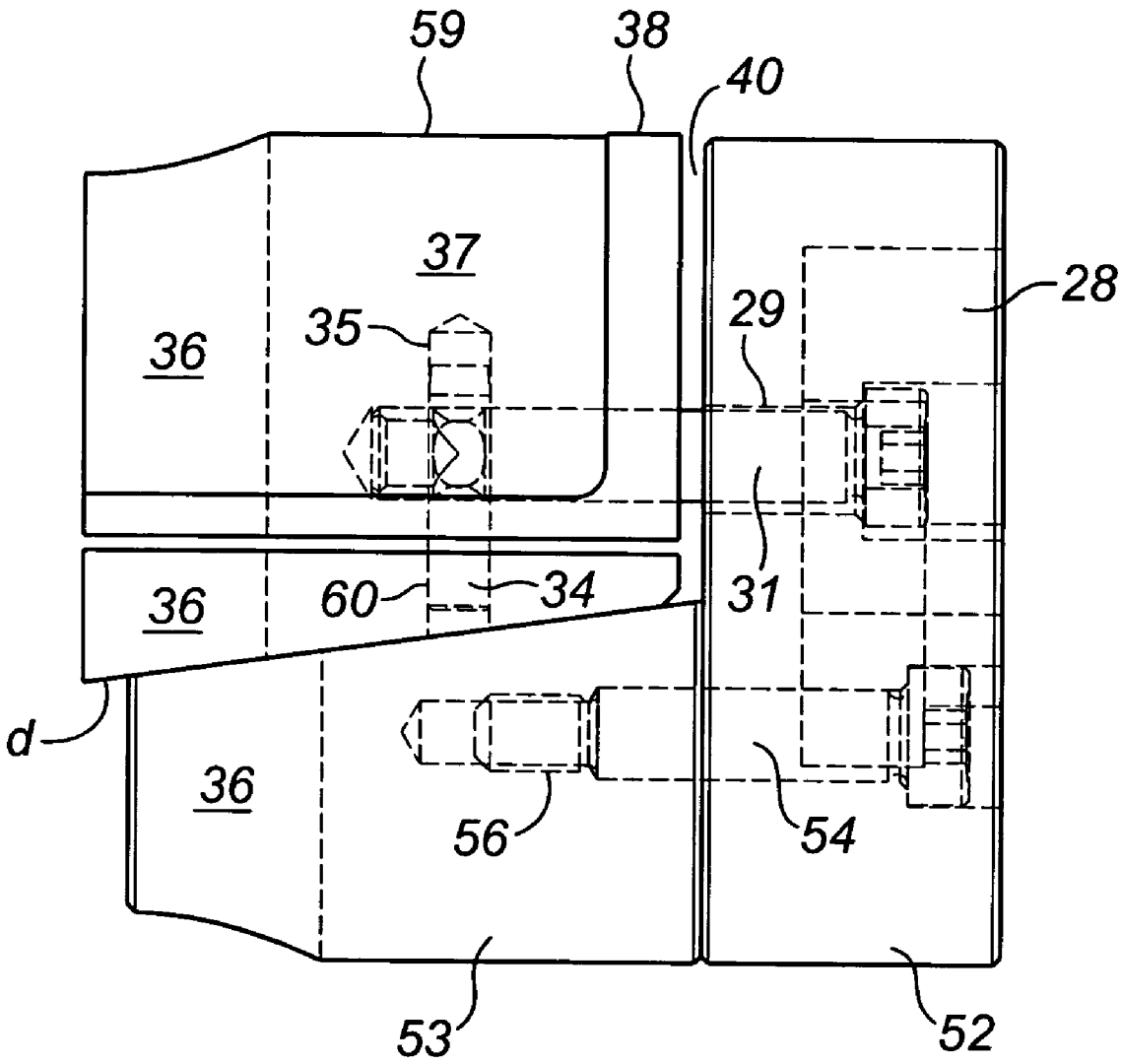

In the sixth embodiment of the invention shown in FIGS. 23–25, the rams 17, 18 are identical to those shown for the fourth embodiment, except that both the body component and the seal component is formed as two pieces. In FIGS. 23–25, like components are labeled as for FIGS. 17–19. The two-piece seal component is labeled generally as 57, and consists of a lower metal wedge portion 58 and an upper thermoplastic seal portion 59. The metal wedge portion 58 provides, at its lower surface, the angled surface 39*a*, which rides on the angled surface 39 of the front wedge portion 53 of the two piece body component 51. The seal portion 59 is similar to that shown for the first embodiment, but is of reduced depth and has a flat lower surface, such that, in its connected form (see FIG. 25), it otherwise has the profile of the seal component described above for the other embodiments. The metal wedge portion 58 is formed with holes 60 aligned with the bores 35 of the seal component 57, such that the connecting pins 31 and locking pins 34 connect the sedge portion 58 to the seal portion 59.

Figure 26:
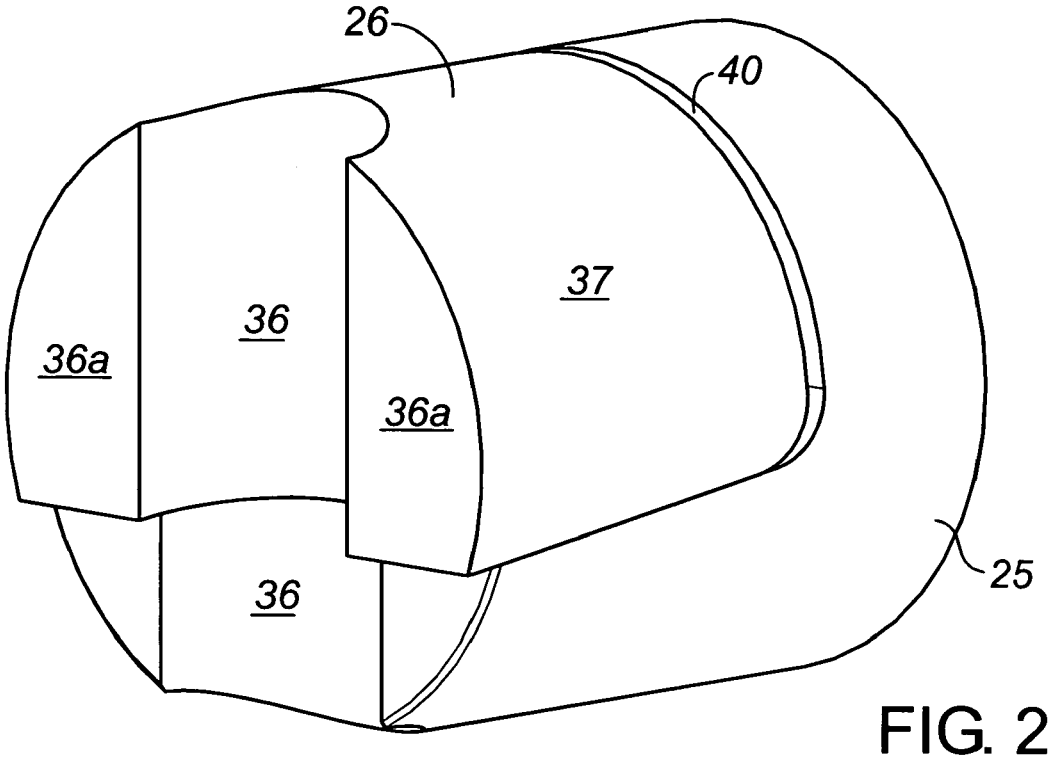
Figure 27:
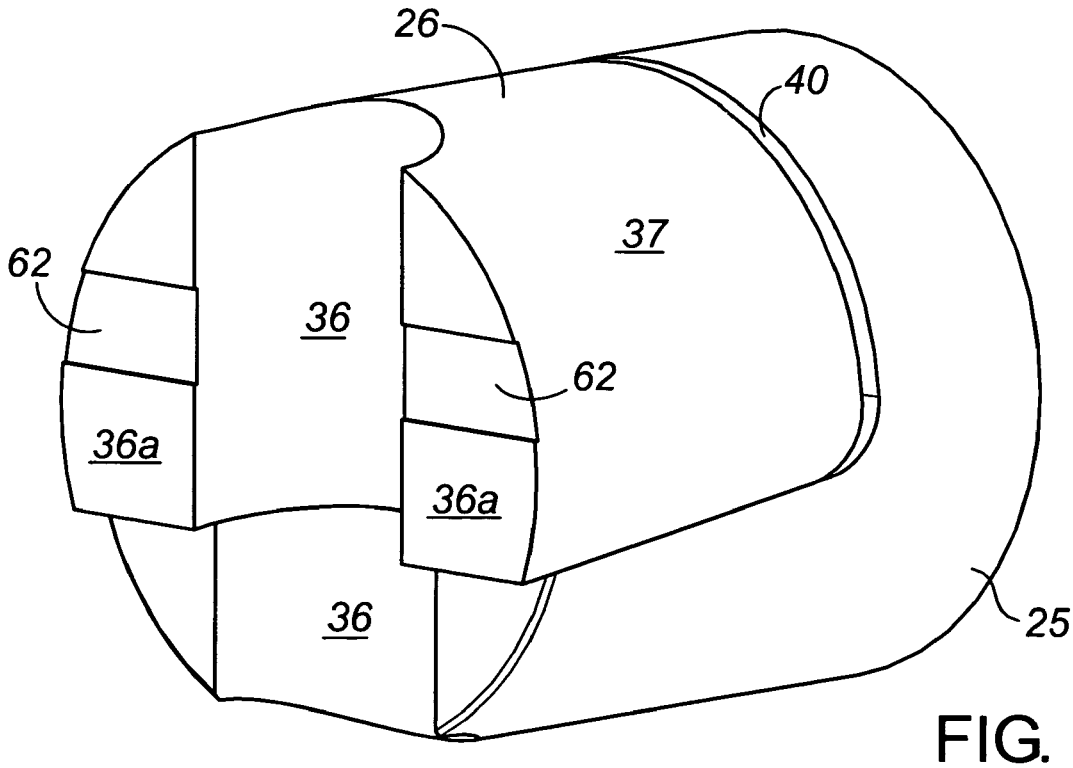
Figure 28:
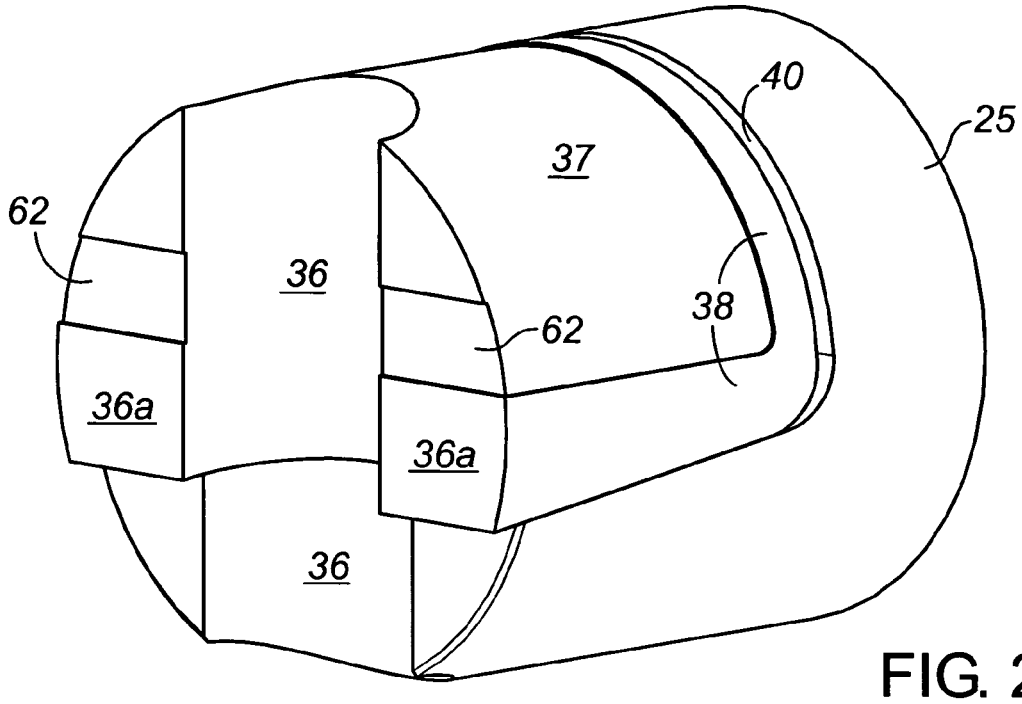
Figure 29:
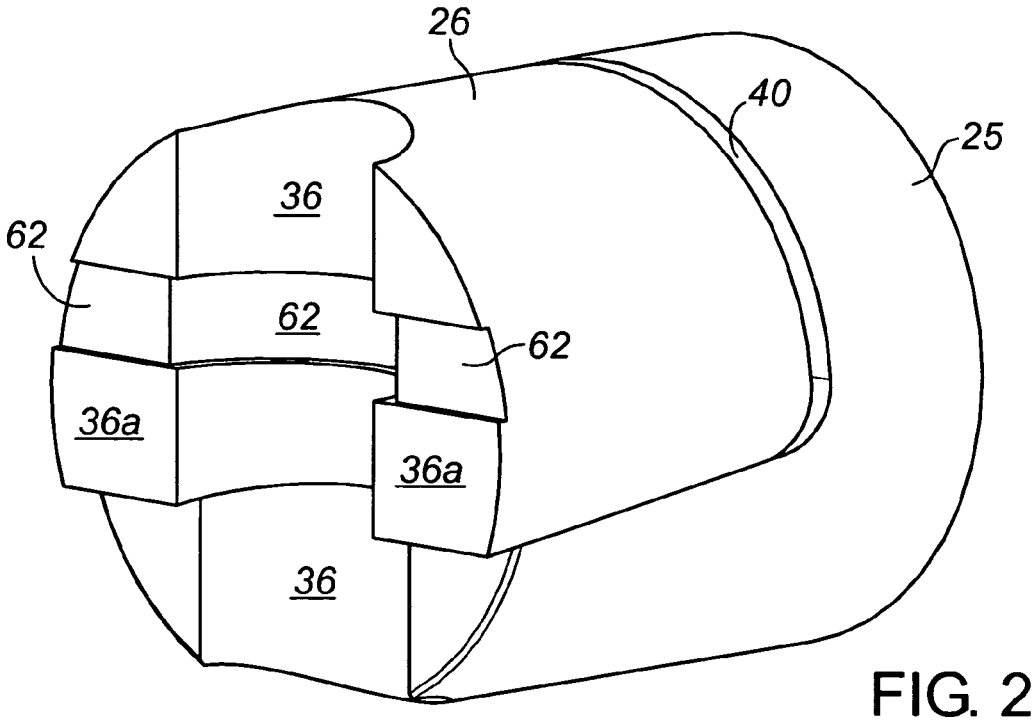
Figure 30:
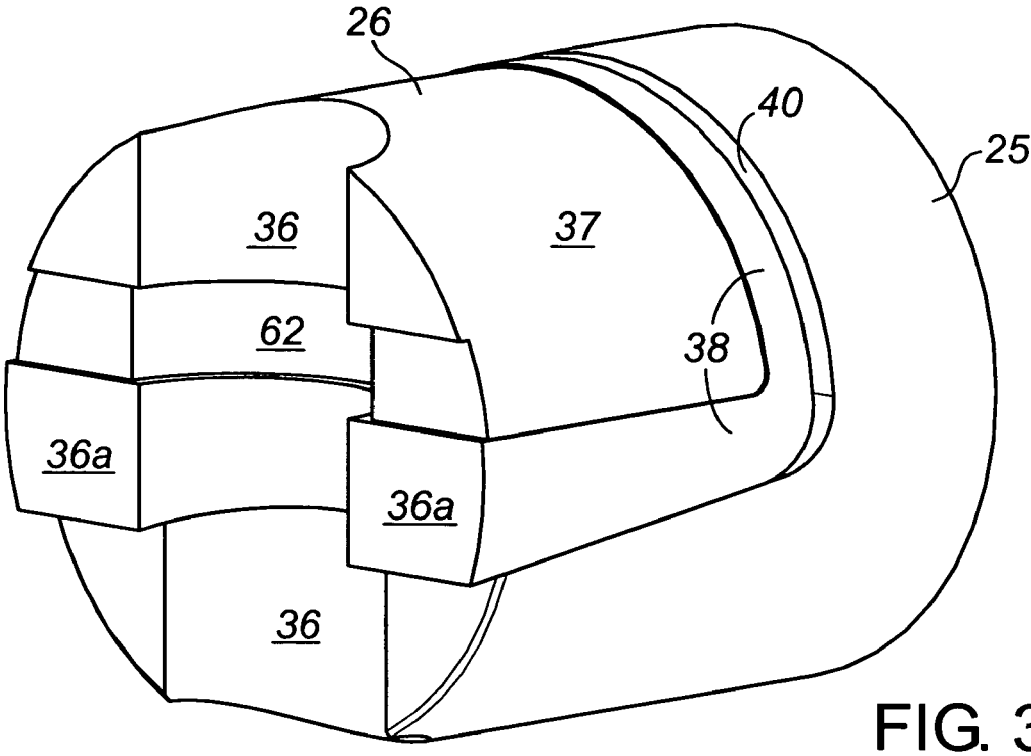
Figure 31:
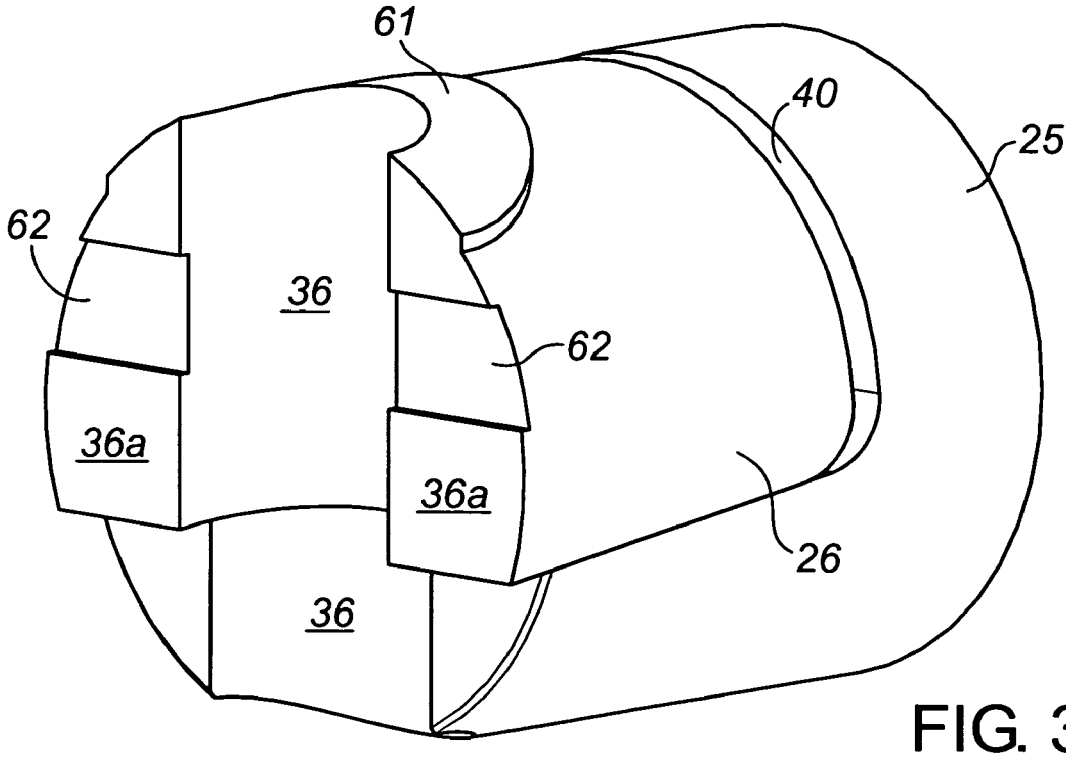
Figure 32:
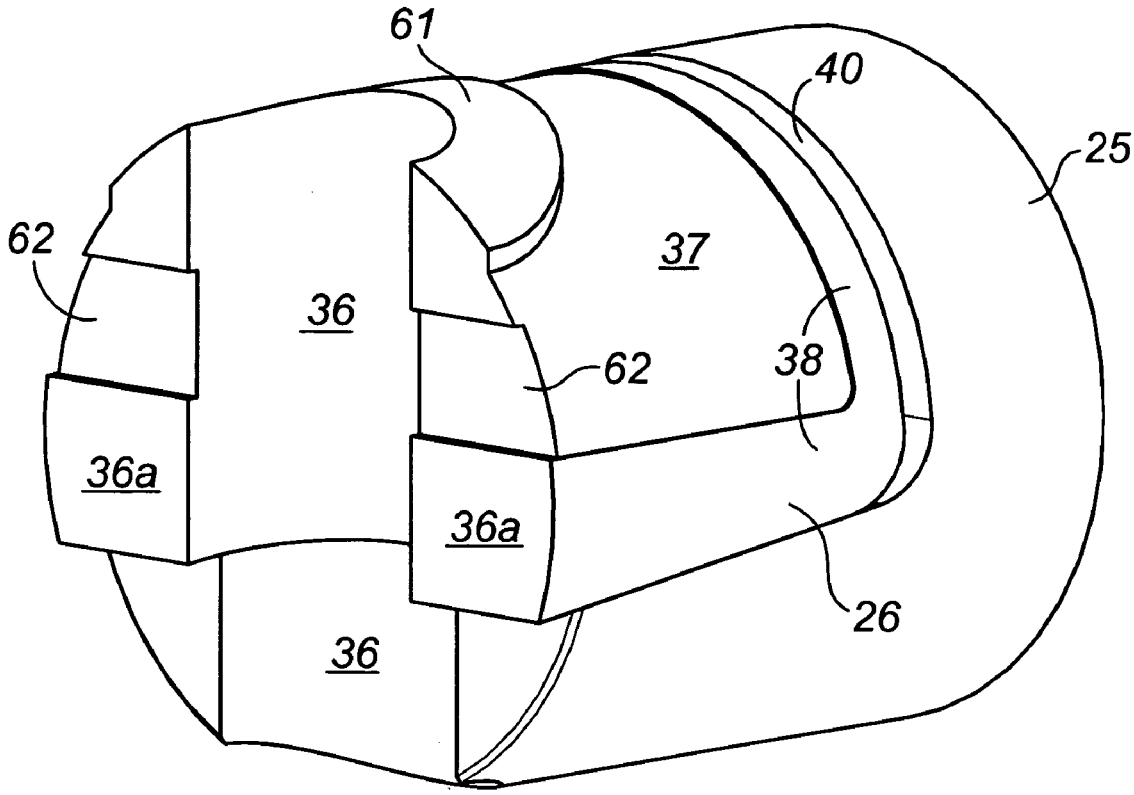

FIGS. 26–32 show seven additional embodiments of the ram of this invention, in an assembled form, with like parts being labeled as above. The embodiment of FIG. 26 shows the seal component 26 formed entirely of the thermoplastic material, and including the vertical radial groove 36 at its front end to accommodate the polish rod P. In this embodiment, no raised ridge sealing surface is initially present. However, after exposing the ram to as sealing environment with pressures typical of those experienced in the vertical bore 12, a vertical bore raised ridge 61, as shown in FIG. 31, is formed in situ. This vertical bore raised ridge 61 then serves in subsequent use to seal the ram against the vertical bore 12. The embodiment shown in FIG. 27 is as in FIG. 26, but shows an adjustment in the sealing face 36*a* at the front end of the seal component 26, in which a cut-away portion 62 is provided, preferably in the central part of the sealing face 36*a*, such that a reduced area of the sealing face 36*a* forms the seal to the sealing face on the opposing ram. FIG. 28 shows a further embodiment similar to that in FIG. 27, but including the peripheral raised ridge sealing surface 38 to the horizontal bore of the BOP. FIG. 29 shows a further embodiment similar to that of FIG. 27, but showing the cut-away portion 62 of the sealing face 36*a* extending around the vertical radial groove 36. FIG. 30 shows a further embodiment similar to that of FIG. 28, that is with the peripheral raised ridge sealing surface 38, but also including the cut-away portion 62 of the sealing face 36*a* extending around the vertical radial groove 36, as in FIG. 29. FIG. 31 and 32 show embodiments of the ram as in FIG. 27 and 28 respectively, but showing the addition of the vertical bore raised ridge sealing surface 61 formed at the front end of the seal component 26, for sealing against the vertical bore 12. As set out above, the vertical bore raised ridge sealing surface 61 may be preformed, for example by milling away to form a reduced radius portion 27 (as described for FIGS. 1–5). Alternatively, the vertical bore raised ridge sealing surface 61 may be formed in situ simply by exposing the ram having a seal component shaped as shown in any of the previous embodiments to the typical pressures of the vertical bore, which cause the surface 61 to be pushed upwardly into the vertical bore 12, thus forming the raised ridge 61. Once formed, the raised ridge 61 acts as a seal to the vertical bore in subsequent operation.

Figure 33:
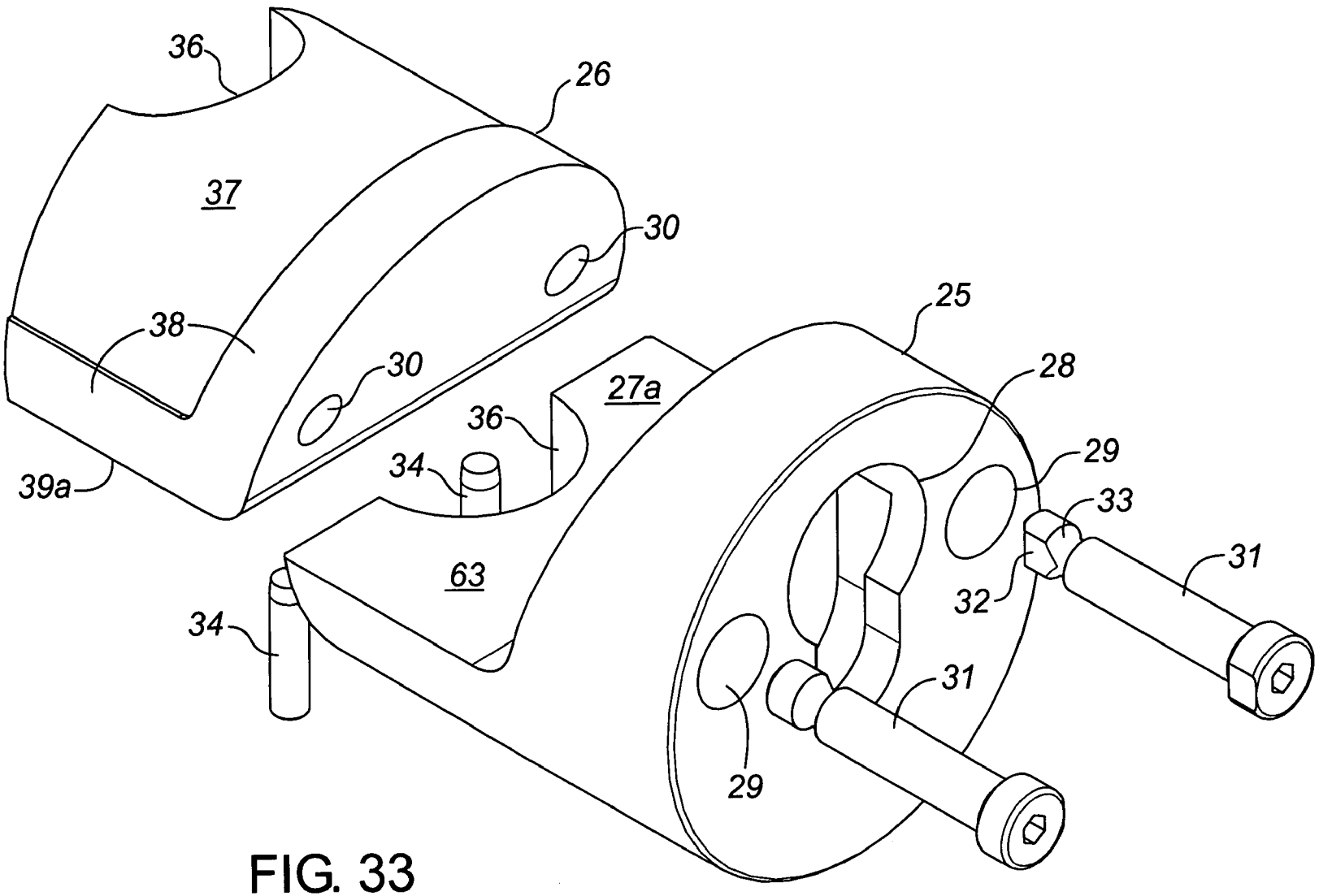
FIGS. 33 and 34 show a still further embodiment of a ram of the present invention, in which the rear support surface of the cut-out of the body component is rearwardly inclined, while the horizontal support surface of the cut-out portion is no longer angled relative to the horizontal, but is generally parallel to the horizontal axis of the ram. In this embodiment, the initial gap between the seal and body component is no longer needed. In these Figures.
Figure 34:
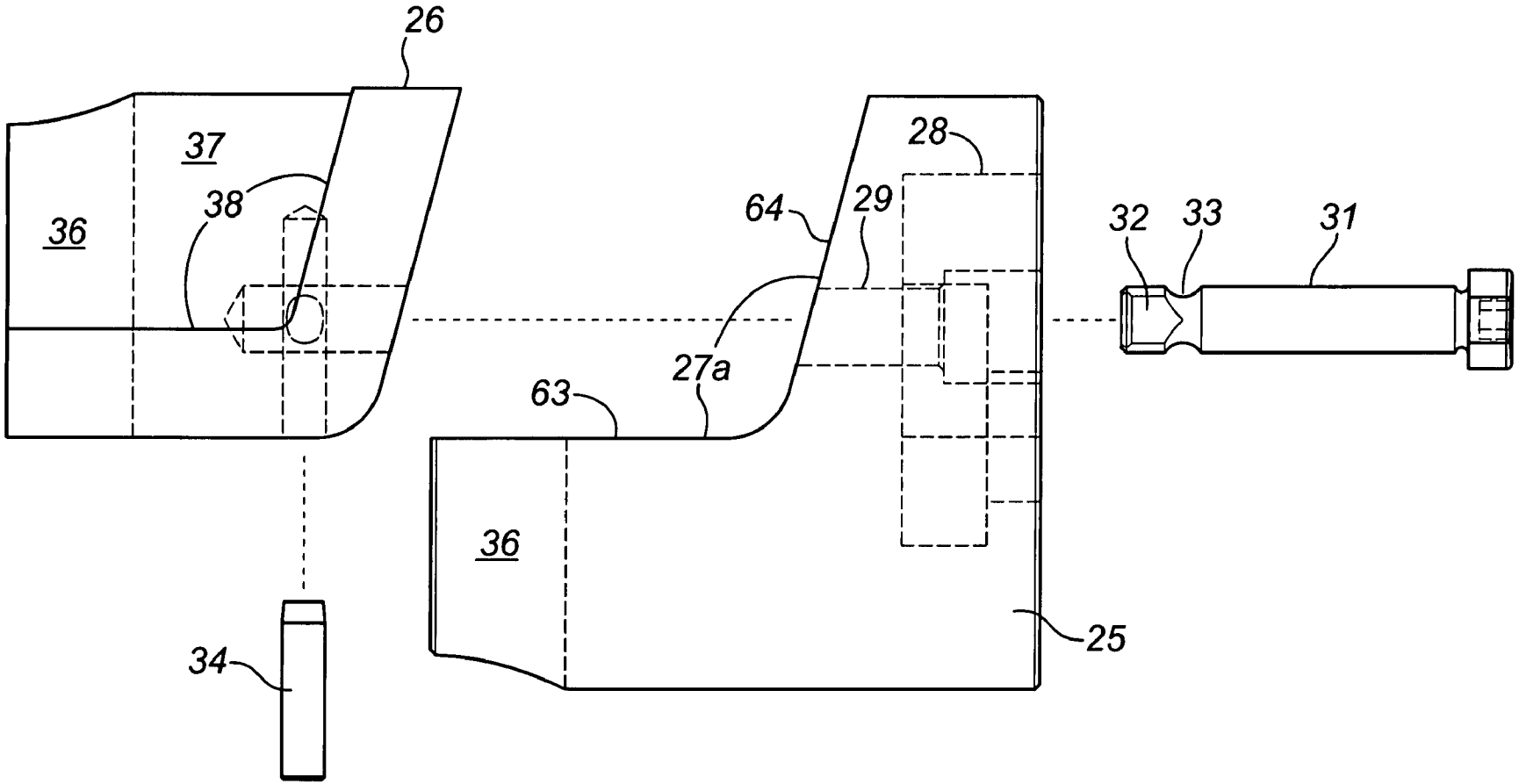
Figure 35:
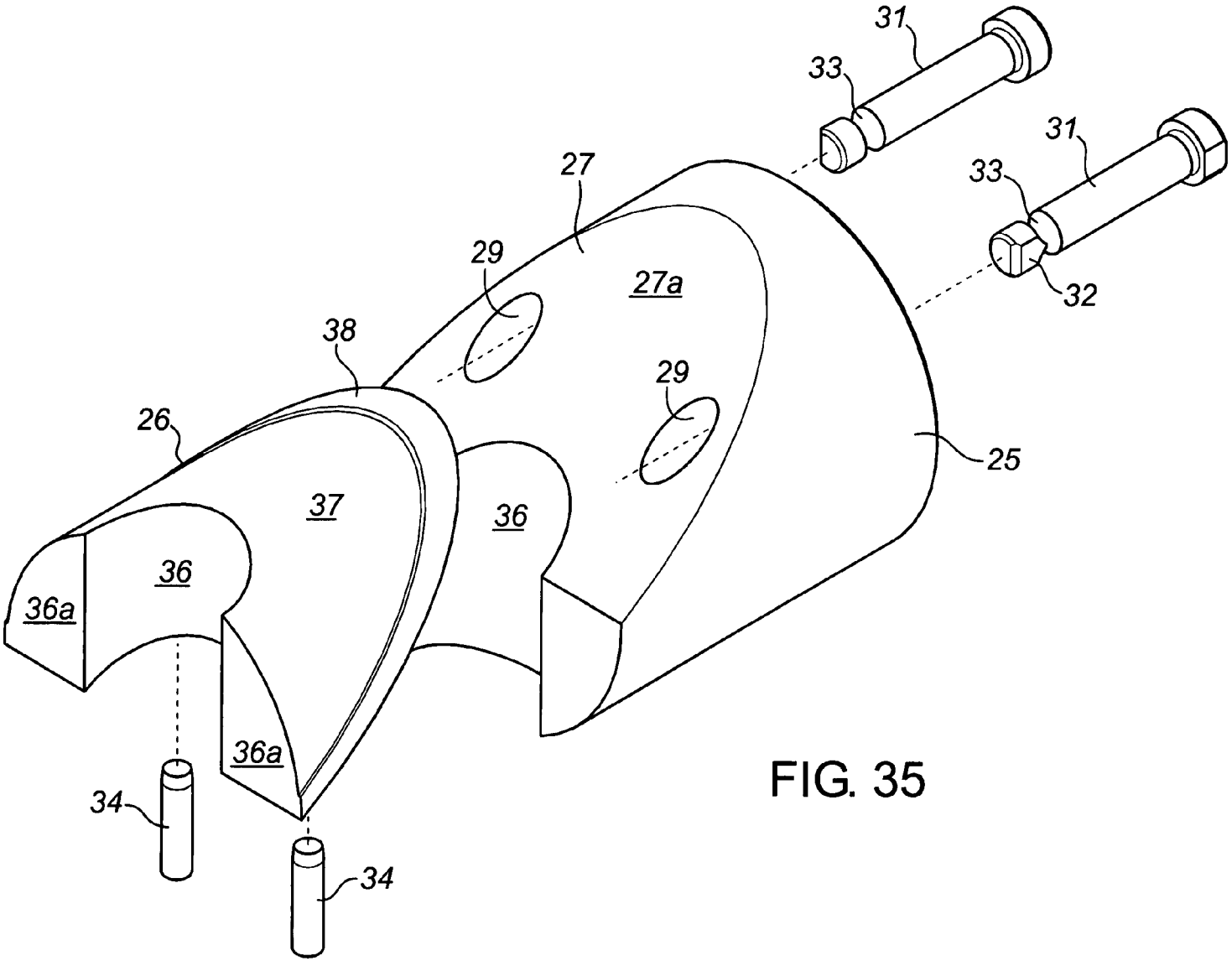
FIG. 35 is a perspective view of yet a further embodiment of a ram of the present invention in an exploded unassembled form, wherein both the cut-out of the body component and seal component are generally wedge shaped. In this embodiment, the initial gap between the seal and body component is no longer needed.

FIGS. 33 and 34 show a further embodiment of a ram of the present invention, in which the cut-out 27 in the front of the body component 25, while still generally L-shaped, are differently configured than for the first embodiment. In the embodiment of FIGS. 33 and 34, the seal support surface 27*a* of the body component 25 and the inner surface of the seal component 26 are both generally L-shaped, but the seal support surface 27*a* is formed with a horizontal support surface 63, which is generally parallel to the horizontal axis of the ram, and a rear support surface 64 which is rearwardly inclined relative to the vertical. Unlike the first embodiment, no gap is needed between the seal and body components, but the front of the seal component 26 protrudes beyond the body component 25, as described in previous embodiments. In sealing engagement, the seal component 26 is pressed against the horizontal and rear support surfaces 63, 64 so as to compress the thermoplastic sealing surface outwardly against the horizontal bore.

Yet a further embodiment of the ram of this invention is shown in FIG. 35, in which the cut-away 27 of the body component 25, as well as the seal component 26, are both generally wedge shaped (with the wide end of the wedge forming the front end of the seal component 26). As with the previous embodiment shown in FIGS. 33 and 34, this embodiment, in an assembled form, has the front end of the seal component protruding beyond the body component, but it does not need an initial gap to be maintained between the body and seal components 25, 26. As the seal component 26 is pressed against the seal support surface 27*a* of the body component 25, the sealing surface of the seal component is compressed outwardly to seal the horizontal bore.

The rams 17, 18 as described above include the seal component 26 above the body component 25. However, it should be apparent that the rams could be rotated such that the seal component 26 is on the bottom. Further, the body and seal components 25, 26 could be modified such that both top and bottom seal components are carried on a more generally T-shaped body component to form the cylindrical rams 17, 18. Furthermore, the components 25, 26 could be oval shaped rather than strictly cylindrical. Furthermore, the body component could be two piece if desired. These and other modifications will be apparent to persons skilled in the art, and are intended to fall within the scope of the present invention.

Testing was conducted using an assembled BOP and polish rod. The rams, according to the second embodiment above, were engaged with the polish rod and hydrostatic pressure was applied below the rams. The rams were demonstrated to withstand the typical hydrostatic pressures of well production.

All publications mentioned in this specification are indicative of the level of skill in the art of this invention. All publications are herein incorporated by reference to the same extent as if each publication was specifically and individually indicated to be incorporated by reference.

The terms and expressions used are, unless otherwise defined herein, used as terms of description and not limitation. There is no intention, in using such terms and expressions, of excluding equivalents of the features illustrated and described, it being recognized that the scope of the invention is defined and limited only by the claims which follow.

I claim:

1. A ram for use in the horizontal bore of a wellhead production blowout preventer to close off the vertical bore of the well, said ram having front and rear ends, a longitudinal axis and being adapted to seal at its front end against either a polish rod of a rod string or an adjacent ram, said ram comprising:

a body component with front and rear portions and ends;

a seal component with front and rear portions and ends;

said body component having an arcuate longitudinal outer surface for conforming with the horizontal bore surface, and having a cut-out in its front portion which provides a seal support surface to support the seal component in both a vertical and horizontal direction;

said seal component having an arcuate longitudinal outer surface for conforming with the horizontal bore surface, and an inner surface which generally conforms to the seal support surface of the body component;

said body component and seal component combining, in an assembled form, to form a full bore ram body, which when out of sealing engagement has the front end of the seal component protruding a horizontal distanced beyond the front end of the body component;

connectors for connecting the seal and body components while allowing the seal component, during sealing engagement, to be pressed against the seal support surface of the body component; and said seal component providing a sealing surface formed of thermoplastic material around the arcuate outer surface for sealing against the horizontal bore;

so that, as the body component is advanced forwardly into a sealing engagement causing the front end of the seal component to contact either the adjacent ram or the polish rod to seal off the vertical bore, the seal component is pressed against the seal support surface of the body component such that the thermoplastic sealing surface is compressed outwardly to seal against the horizontal bore.

2. The ram of claim 1, wherein the thermoplastic sealing surface of the seal component includes a raised ridge sealing surface formed of thermoplastic material around the arcuate outer surface for sealing against the horizontal bore.

3. The ram of claim 2, wherein the raised ridge sealing surface includes one or both of a peripheral raised ridge sealing surface located at the peripheral edges of the seal component adjacent the body component, or a vertical bore raised ridge sealing surface located at the front end of the seal component in the area which is exposed to the vertical bore when in a sealing engagement.

4. The ram of claim 3, wherein the seal component is formed from a thermoplastic material and wherein the vertical bore raised ridge sealing surface, if present, is either preformed by forming a reduced radius portion on the outer arcuate surface of the seal component, or by forming the raised ridge sealing surface in situ by sealing the ram against the vertical bore.

5. The ram of claim 4, wherein the seal component is formed of thermoplastic material, and wherein the peripheral raised ridge sealing surface, if present, is formed by forming a reduced radius portion on the outer arcuate surface of the seal component to form the peripheral raised ridge surface at its peripheral edges adjacent the body component.

6. The ram of claim 1, wherein the seal support surface of the body component and the inner surface of the seal component are both generally L-shaped, said seal support surface having a horizontal support surface which is generally parallel to the horizontal axis of the ram, and a rear support surface which is rearwardly inclined relative to the vertical, such that in sealing engagement, the seal component is pressed against the horizontal and rear support surfaces so as to compress the thermoplastic sealing surface outwardly against the horizontal bore.

7. The ram of claim 4, wherein the seal support surface of the body component and the inner surface of the seal component are both generally L-shaped, said seal support surface having a horizontal support surface which is generally parallel to the horizontal axis of the ram, and a rear support surface which is rearwardly inclined relative to the vertical, such that in sealing engagement, the seal component is pressed against the horizontal and rear support surfaces so as to compress the thermoplastic sealing surface outwardly against the horizontal bore.

8. The ram of claim 1, wherein the seal support surface of the body component forms an acutely angled surface, relative to its longitudinal axis, against which the seal component is pressed during sealing engagement to seal off the vertical and horizontal bores.

9. The ram of claim 4, wherein the seal support surface of the body component forms an acutely angled surface, relative to its longitudinal axis, against which the seal component is pressed during sealing engagement to seal off the vertical and horizontal bores.

10. The ram of claim 9, wherein the seal component and the cut-out portion of the body component are both generally wedge shaped, with the wide end of the wedge shaped seal component being the front end.

11. The ram of claim 1, wherein the seal support surface of the body component and the inner surface of the seal component are both generally L-shaped.

12. The ram of claim 7, wherein the seal support surface of the body component and the inner surface of the seal component are both generally L-shaped.

13. The ram of claim 12, wherein the L-shaped seal support surface of the body component forms an acutely angled surface, relative to its longitudinal axis; wherein the body component and seal component, when combined in the assembled form, form a gap, whose horizontal width is less than d, between the seal and body components at the rear end of the seal component, and wherein the L-shaped inner surface of the seal component is adapted to ride upwardly and rearwardly on the acutely angled surface of the body component during sealing engagement to close the gap and to compress the seal component outwardly to seal against the horizontal bore.

14. The ram of claim 12, wherein the seal component is formed in two parts, a steel ram insert forming a groove at its front end and its peripheral edges adjacent the body component, and a thermoplastic seal insert held in the groove, said thermoplastic seal insert forming the peripheral raised ridge sealing surface.

15. The ram of claim 13, wherein the seal component is formed in two parts, a lower steel wedge portion and an upper thermoplastic seal portion, which are connected together with connectors to form the seal component, and wherein the lower wedge portion forms the angled surface at its lower surface which rides on the angled surface of the body component.

16. The ram of claim 14, wherein the seal component is formed in two parts, a lower steel wedge portion and an upper thermoplastic seal portion, which are connected together with connectors to form the seal component, and wherein the lower wedge portion forms the angled surface at its lower surface which rides on the angled surface of the body component.

17. The ram of claim 13, wherein the body component is formed in two parts, a rear plate portion and a front wedge portion, which are connected together with connectors to form the L-shaped body component.

18. The ram of claim 14, wherein the body component is formed in two parts, a rear plate portion and a front wedge portion, which are connected together with connectors to form the L-shaped body component.

19. The ram of claim 15, wherein the body component is formed in two parts, a rear plate portion and a front wedge portion, which are connected together with connectors to form the L-shaped body component.

20. The ram of claim 1, wherein the front end of the seal component provides a sealing face to seal against either the polish rod or the sealing face of an opposing ram, and wherein the sealing face includes a cut-away portion such that a reduced area of the sealing face forms the seal.

21. The ram of claim 7, wherein the front end of the seal component provides a sealing face to seal against either the polish rod or the sealing face of an opposing ram, and wherein the sealing face includes a cut-away portion such that a reduced area of the sealing face forms the seal.

22. The ram of claim 9, wherein the front end of the seal component provides a sealing face to seal against either the polish rod or the sealing face of an opposing ram, and wherein the sealing face includes a cut-away portion such that a reduced area of the sealing face forms the seal.

23. The ram of claim 10, wherein the front end of the seal component provides a sealing face to seal against either the polish rod or the sealing face of an opposing ram, and wherein the sealing face includes a cut-away portion such that a reduced area of the sealing face forms the seal.

24. The ram of claim 12, wherein the front end of the seal component provides a sealing face to seal against either the polish rod or the sealing face of an opposing ram, and wherein the sealing face includes a cut-away portion such that a reduced area of the sealing face forms the seal.

25. The ram of claim 13, wherein the front end of the seal component provides a sealing face to seal against either the polish rod or the sealing face of an opposing ram, and wherein the sealing face includes a cut-away portion such that a reduced area of the sealing face forms the seal.

26. The ram of claim 14, wherein the front end of the seal component provides a sealing face to seal against either the polish rod or the sealing face of an opposing ram, and wherein the sealing face includes a cut-away portion such that a reduced area of the sealing face forms the seal.

27. The ram of claim 16, wherein the front end of the seal component provides a sealing face to seal against either the polish rod or the sealing face of an opposing ram, and wherein the sealing face includes a cut-away portion such that a reduced area of the sealing face forms the seal.

28. The ram of claim 1, wherein the front portion of the body component is generally T-shaped with two cut-outs providing two seal support surfaces, and wherein the ram includes two seal components, each adapted to be pressed against one of the seal support surfaces during sealing engagement and each having the front end protruding beyond the front end of the body component.

29. The ram of claim 7, wherein the front portion of the body component is generally T-shaped with two cut-outs providing two seal support surfaces, and wherein the ram includes two seal components, each adapted to be pressed against one of the seal support surfaces during sealing engagement and each having the front end protruding beyond the front end of the body component.

30. The ram of claim 9, wherein the front portion of the body component is generally T-shaped with two cut-outs providing two seal support surfaces, and wherein the ram includes two seal components, each adapted to be pressed against one of the seal support surfaces during sealing engagement and each having the front end protruding beyond the front end of the body component.

31. The ram of claim 10, wherein the front portion of the body component is generally T-shaped with two cut-outs providing two seal support surfaces, and wherein the ram includes two seal components, each adapted to be pressed against one of the seal support surfaces during sealing engagement and each having the front end protruding beyond the front end of the body component.

32. The ram of claim 12, wherein the front portion of the body component is generally T-shaped with two cut-outs providing two seal support surfaces, and wherein the ram includes two seal components, each adapted to be pressed against one of the seal support surfaces during sealing engagement and each having the front end protruding beyond the front end of the body component.

33. The ram of claim 13, wherein the front portion of the body component is generally T-shaped with two cut-outs providing two seal support surfaces, and wherein the ram includes two seal components, each adapted to be pressed against one of the seal support surfaces during sealing engagement and each having the front end protruding beyond the front end of the body component.

34. The ram of claim 14, wherein the front portion of the body component is generally T-shaped with two cut-outs providing two seal support surfaces, and wherein the ram includes two seal components, each adapted to be pressed against one of the seal support surfaces during sealing engagement and each having the front end protruding beyond the front end of the body component.

35. The ram of claim 16, wherein the front portion of the body component is generally T-shaped with two cut-outs providing two seal support surfaces, and wherein the ram includes two seal components, each adapted to be pressed against one of the seal support surfaces during sealing engagement and each having the front end protruding beyond the front end of the body component.

36. The ram of claim 1, wherein the seal and body components are formed with a vertical radial groove at their front edges to accommodate the polish rod.

37. The ram of claim 7, wherein the seal and body components are formed with a vertical radial groove at their front edges to accommodate the polish rod.

38. The ram of claim 9, wherein the seal and body components are formed with a vertical radial groove at their front edges to accommodate the polish rod.

39. The ram of claim 10, wherein the seal and body components are formed with a vertical radial groove at their front edges to accommodate the polish rod.

40. The ram of claim 12, wherein the seal and body components are formed with a vertical radial groove at their front edges to accommodate the polish rod.

41. The ram of claim 13, wherein the seal and body components are formed with a vertical radial groove at their front edges to accommodate the polish rod.

42. The ram of claim 14, wherein the seal and body components are formed with a vertical radial groove at their front edges to accommodate the polish rod.

43. The ram of claim 16, wherein the seal and body components are formed with a vertical radial groove at their front edges to accommodate the polish rod.

44. The ram of claim 5, wherein the seal support surface of the body component and the inner surface of the seal component are both generally L-shaped.

45. The ram of claim 44, wherein the L-shaped seal support surface of the body component forms an acutely angled surface, relative to its longitudinal axis; wherein the body component and seal component, when combined in the assembled form, form a gap, whose horizontal width is less than d, between the seal and body components at the rear end of the seal component, and wherein the L-shaped inner surface of the seal component is adapted to ride upwardly and rearwardly on the acutely angled surface of the body component during sealing engagement to close the gap and to compress the seal component outwardly to seal against the horizontal bore.

46. The ram of claim 45, wherein the seal and body components are formed with a vertical radial groove at their front edges to accommodate the polish rod.

47. The ram of claim 46, wherein the seal component includes the vertical raised ridge sealing surface formed in situ by sealing the ram against the vertical bore.

48. The ram of claim 45, wherein the front end of the seal component provides a sealing face to seal against the polish rod, and wherein the sealing face includes a cut-away portion such that a reduced area of the sealing face forms the seal.

49. A production blowout preventer, comprising:

a housing forming a vertical bore extending longitudinally therethrough and a pair of coaxial horizontal ram bores, each having a longitudinal axis and a horizontal bore surface, extending transversely thereof, and intersecting the vertical bore;

a pair of rams positioned in the ram bores, each ram having front and rear ends, the rams being slidable along the ram bores so as to project into the vertical bore where their front ends may seal either against each other or against a polish rod of a rod string extending therethrough; and means for advancing and withdrawing the rams between sealing and open positions;

each ram comprising:

a body component with front and rear portions and ends;

a seal component with front and rear portions and ends;

said body component having an arcuate longitudinal outer surface for conforming with the horizontal bore surface, and having a cut-out in its front portion which provides a seal support surface to support the seal component in both a vertical and horizontal direction;

said seal component having an arcuate longitudinal outer surface for conforming with the horizontal bore surface, and an inner surface which generally conforms to the seal support surface of the body component;

said body component and seal component combining, in an assembled form, to form a full bore ram body, which when out of sealing engagement has the front end of the seal component protruding a horizontal distanced beyond the front end of the body component;

connectors for connecting the seal and body components while allowing the seal component, during sealing engagement, to be pressed against the seal support surface of the body component; and said seal component providing a sealing surface formed of thermoplastic material around the arcuate outer surface for sealing against the horizontal bore;

so that, as the body component is advanced forwardly into a sealing engagement causing the front end of the seal component to contact either the adjacent ram or the polish rod to seal off the vertical bore, the seal component is pressed against the seal support surface of the body component such that the thermoplastic sealing surface is compressed outwardly to seal against the horizontal bore.

* * * * *